US012325552B2

(12) United States Patent
Khandelwal et al.

(10) Patent No.: US 12,325,552 B2
(45) Date of Patent: Jun. 10, 2025

(54) PLASTIC PALLET WITH REMOVABLE ELASTOMER FOOTPADS

(71) Applicant: SABIC Global Technologies B.V., Bergen op Zoom (NL)

(72) Inventors: Ratnesh Khandelwal, Bangalore (IN); Raghavendra Janiwarad, Bangalore (IN); Abdul Rahim Ahamed Arafath, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 126 days.

(21) Appl. No.: 18/270,442

(22) PCT Filed: Dec. 17, 2021

(86) PCT No.: PCT/EP2021/086630
§ 371 (c)(1),
(2) Date: Jun. 29, 2023

(87) PCT Pub. No.: WO2022/144196
PCT Pub. Date: Jul. 7, 2022

(65) Prior Publication Data

US 2024/0059453 A1 Feb. 22, 2024

(30) Foreign Application Priority Data

Dec. 31, 2020 (EP) ..... 20217960

(51) Int. Cl.
*B65D 19/40* (2006.01)
*B65D 19/00* (2006.01)

(52) U.S. Cl.
CPC ..... *B65D 19/40* (2013.01); *B65D 19/0016* (2013.01); *B65D 2519/00034* (2013.01);
(Continued)

(58) Field of Classification Search
CPC ..... B65D 19/40; B65D 19/0016; B65D 2519/00034; B65D 2519/00069;
(Continued)

(56) References Cited

U.S. PATENT DOCUMENTS 5,343,814 A * 9/1994 Pigott ..... B65D 19/0012 108/56.1
5,497,709 A * 3/1996 Gonzalez ..... B65D 19/0012 108/56.3
(Continued)

FOREIGN PATENT DOCUMENTS

DE 202007011531 U1 10/2007
EP 1980495 A1 10/2008
(Continued)

OTHER PUBLICATIONS

International Search Report for International Application No. PCT/EP2021/086630; International Filing Date Dec. 17, 2021; Date of Mailing Apr. 7, 2022; 5 pages.
(Continued)

*Primary Examiner* — Jose V Chen
(74) *Attorney, Agent, or Firm* — CANTOR COLBURN LLP

(57) ABSTRACT

Disclosed is a transport system (100), including: a pallet (110), formed from plastic, wherein the pallet extends heightwise from a pallet top deck (130) to a pallet bottom deck (140) to define a pallet height, lengthwise from a pallet forward end (160) to a pallet aft end (170) to define a pallet length, and widthwise from a pallet first side (190) to a pallet second side (200) to define a pallet width, wherein the pallet bottom deck defines a pocket (210), the pocket defines a pocket sidewall that extends heightwise into the pallet, from the pallet bottom deck to a pocket base to define a pocket height; and a pad (240), formed of an elastomer, having
(Continued)

complementary shape to the pocket and configured to be removably secured within the pocket, to define a pallet foot.

20 Claims, 16 Drawing Sheets

(52) U.S. Cl.
CPC ..... *B65D 2519/00069* (2013.01); *B65D 2519/00273* (2013.01); *B65D 2519/00288* (2013.01); *B65D 2519/00318* (2013.01); *B65D 2519/00333* (2013.01); *B65D 2519/00572* (2013.01); *B65D 2519/0084* (2013.01)

(58) Field of Classification Search
CPC ..... B65D 2519/00293; B65D 2519/00288; B65D 2519/00318; B65D 2519/00333; B65D 2519/00572; B65D 2519/0084
USPC ..... 108/57.25, 53.1
See application file for complete search history.

(56) References Cited

U.S. PATENT DOCUMENTS 5,887,529 A * 3/1999 John ..... B65D 19/0018 108/57.33
5,967,057 A * 10/1999 Nakayama ..... B29C 45/1704 108/57.25
6,109,190 A * 8/2000 Hale ..... B65D 19/0016 108/57.25
6,283,044 B1 * 9/2001 Apps ..... B65D 19/0022 108/57.25
6,976,436 B1 * 12/2005 Sugihara ..... B65D 19/0026 108/57.25
7,748,329 B2 * 7/2010 Baltz ..... B65D 19/0048 108/57.25
11,225,356 B2 * 1/2022 Wood ..... B65D 19/385
11,731,804 B2 * 8/2023 Dehmel ..... B65D 19/0048 108/57.25
11,787,598 B2 * 10/2023 D'Emidio ..... H04L 67/63 108/57.25
2003/0061974 A1 * 4/2003 Smyers ..... B65D 19/0012 108/57.33
2004/0134391 A1 * 7/2004 Sugihara ..... B65D 19/38 108/57.25
2005/0150892 A1 7/2005 Miller
2007/0028814 A1 * 2/2007 Swistak ..... B65D 19/0004 108/51.11
2007/0056483 A1 * 3/2007 Garcia ..... B65D 19/004 108/57.25
2007/0131148 A1 * 6/2007 Wu ..... B65D 19/0018 108/57.25
2007/0204769 A1 * 9/2007 Wong ..... B65D 19/0016 108/57.25
2007/0256609 A1 * 11/2007 Naidu ..... B65D 19/0073 108/108
2008/0236455 A1 * 10/2008 Naidu ..... B65D 19/0038 24/453
2009/0007824 A1 * 1/2009 Dubois ..... B65D 19/18 108/57.25
2012/0204768 A1 * 8/2012 Ritzberger ..... B65D 19/18 108/57.25
2016/0039566 A1 * 2/2016 Lorenz ..... B65D 19/0006 108/57.25
2020/0002053 A1 * 1/2020 Zhang ..... B65D 19/0095
2020/0148416 A1 * 5/2020 Daubenspeck .... B65D 19/0026
2023/0192358 A1 * 6/2023 Li ..... B65D 19/385 108/57.25
2024/0246722 A1 * 7/2024 Hawley ..... B65D 19/0097
2024/0383633 A1 * 11/2024 Hixson ..... B65D 1/18

FOREIGN PATENT DOCUMENTS

JP S4924837 Y1 7/1974
JP S56109921 U 8/1981
JP H1077037 A 3/1998

OTHER PUBLICATIONS

Written Opinion for International Application No. PCT/EP2021/086630; International Filing Date Dec. 17, 2021; Date of Mailing Apr. 7, 2022; 7 pages.

* cited by examiner

PLASTIC PALLET WITH REMOVABLE ELASTOMER FOOTPADS

CROSS-REFERENCE TO RELATED APPLICATIONS

This application is a National Stage application of PCT/EP2021/086630, filed Dec. 17, 2021, which claims the benefit of European Application No. 20217960.2, filed Dec. 31, 2020, both of which are incorporated by reference in their entireties herein.

TECHNICAL FIELD

Disclosed herein is a pallet for moving freight and more specifically to a plastic pallet with removable elastomer footpads. Also disclosed herein is a support system.

BACKGROUND

Pallets are portable rigid platforms used to consolidate shipments and allow for ease of freight movement. Pallets are commonly made of either wood or plastic. Plastic pallets loaded with freight can be moved from one location to another, such as when loading a freight truck, via a chain conveyor system. Slippage between chains of the chain conveyor and the plastic pallets can generate frictional heat leading to damage. Complicating a solution is that there is no one standard spacing between the chains in conveyor systems. There is a desire to prevent the occurrence of such damage to a plastic pallet.

DE 20 2007 011531 teaches a transport pallet, consisting of a support surface for the goods to be transported and on the underside thereof spaced blocks designed as feet, which is characterized in that at least some of the blocks on or near the outer circumference of the Pallet are arranged, a recess open to an outside is provided in which at least one holding element firmly connected to the block is arranged.

JP H10 77037 A teaches a non-slip member which is utilized to impart non-slip properties to the synthetic resin pallets, strip, formed in a strip shape from a slip resistant material and parts, a cylindrical insertion leg tip is opened while being more disposed spaced to one side of the strip portion, characterized in that integrally provided JP S49 24837 Y1 teaches a palette having a number of reinforcing ribs.

EP 1 980 495 A1 teaches a multifunctional pallet for transporting goods by means of manipulation with a forklift, consisting of a single-part body comprised of a platform, the lower side of which, in correspondence with their vertices, comprises support legs, characterized in that the platform has a flat upper side with a plurality of slots configured to couple panels that laterally contain objects disposed on the platform.

US 2005/150892 A1 teaches a container includes a base having both side and end walls connected thereto to form a body having an opening at the top closed by a removable lid. The walls are made of a double walled construction and include an outer panel and an inner panel. An inwardly recessed ledge is formed adjacent the top to receive and mate with a lower rim of the lid. At least one latch member is mounted completely within an upper portion of each of two opposed walls and is movable between a locked and an unlocked position to lock or unlock the lid on the body of the container.

SUMMARY

Disclosed is a transport system, including: a pallet, formed from plastic, wherein the pallet extends heightwise from a pallet top deck to a pallet bottom deck to define a pallet height, lengthwise from a pallet forward end to a pallet aft end to define a pallet length, and widthwise from a pallet first side to a pallet second side to define a pallet width, wherein, the pallet bottom deck defines a pocket, the pocket defines a pocket sidewall that extends heightwise into the pallet, from the pallet bottom deck to a pocket base to define a pocket height; and a pad, formed of an elastomer, having complementary shape to the pocket and configured to be removably secured within the pocket, to define a pallet foot.

Further disclosed is a pad for placement in a pocket of a pallet, the pad including: a pad top surface, wherein: the pad extends heightwise from the pad top surface that to a pad bottom surface to define a pad height, the pad extends lengthwise from a pad forward end to a pad aft end to define a pad length, and the pad extends widthwise from a pad first side to a pad second side to define a pad width; pad ribs extend heightwise from the pad bottom surface, the pad ribs extend lengthwise from the pad forward end to the pad aft end, and the pad ribs are spaced widthwise from each other so that adjacent pairs of the pad ribs respectively define a chain receiving track; and the pad is formed of an elastomer.

Further disclosed is a method including: positioning elastomer pads in pockets formed about a bottom deck of a plastic pallet that is configured to transport freight; and removing the pads from the pockets after transporting freight.

Further disclosed is a support system including: a primary platform defining a plastic pallet, the primary platform formed by primary platform segments, that are interconnectable with each other, the primary platform segments each include a first side and a second side, the first and second sides, each define one of notches and tabs to respectively mate with tabs and notches of other ones of the primary platform segments, to thereby interconnect adjacent ones of the primary platform segments, wherein the primary platform segments each define primary legs extending downwardly therefrom, wherein the primary legs are sized to impart a primary slope along the primary platform, wherein the primary slope is 0.5 to 5 degrees, for example, one degree; and secondary platform segments that are interconnectable with each other and with the primary platform segments to form an extension of the primary platform, wherein the secondary platform segments each define secondary legs extending downwardly therefrom, wherein the secondary legs are sized so that the primary platform and the extension of the primary platform are smoothly continuous and planar with each other, wherein the primary platform has one of a circular and a rectangular shape; and wherein the primary platform has one of a continuous and a discontinuous top surface.

These and other features and characteristics are more particularly described below.

BRIEF DESCRIPTION OF THE DRAWINGS

The following is a brief description of the drawings wherein like elements are numbered alike and which is presented for the purposes of illustrating the exemplary embodiments disclosed herein and not for the purposes of limiting the same.

DETAILED DESCRIPTION

Figure 1A:
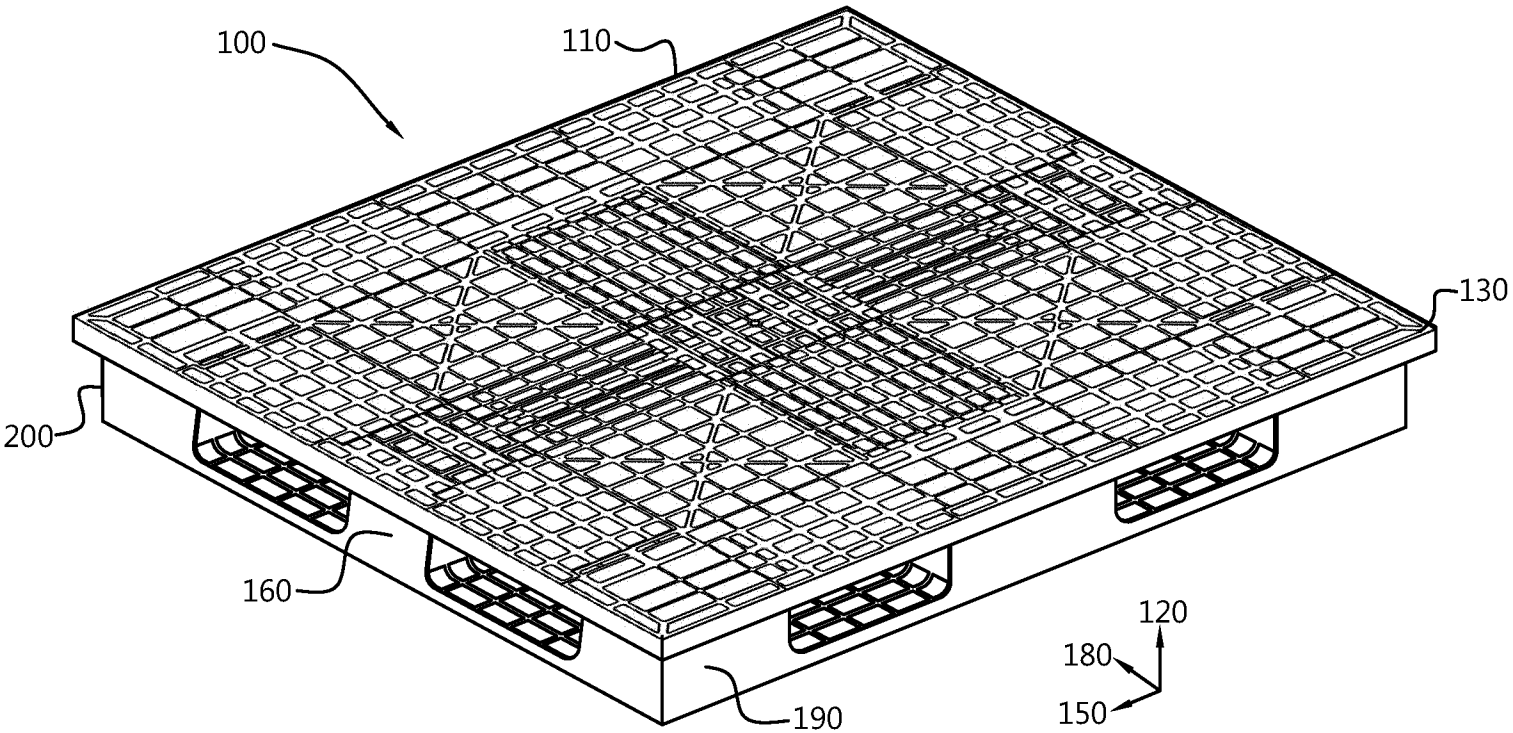
FIG. 1A shows a top perspective view of a pallet according to an embodiment.
Figure 1B:
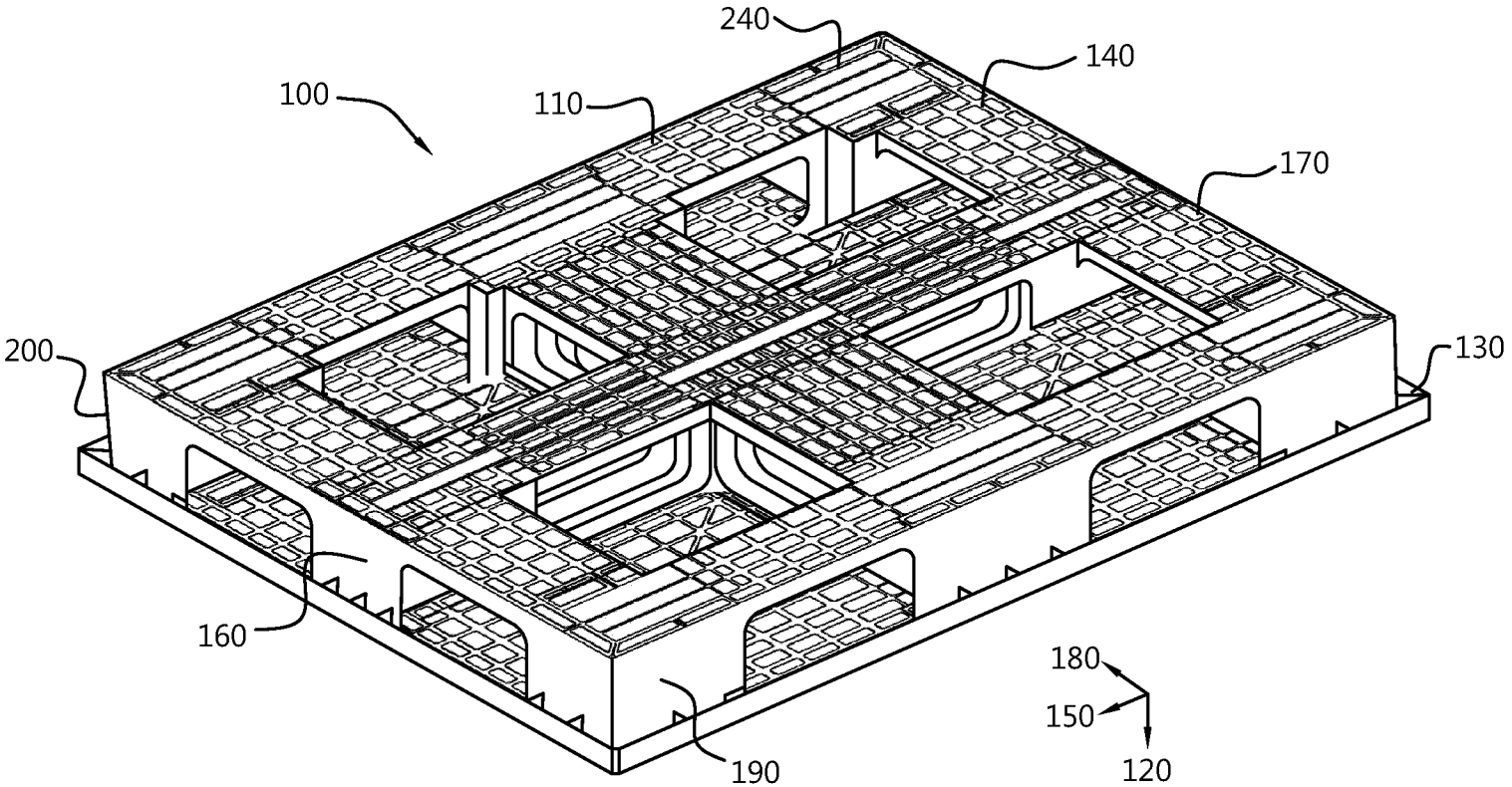
FIG. 1B shows a bottom perspective view of a pallet with pads located in pockets formed in the pallet according to an embodiment.

A detailed description of one or more embodiments of the disclosed apparatus and method are presented herein by way of exemplification and not limitation with reference to the Figures.

As indicated, plastic pallets, loaded with freight, can be moved from one location to another, such as when loading a freight truck, via a chain conveyor system. Slippage between chains of the chain conveyor and plastic pallets can generate frictional heat leading to damage. Complicating a solution is that there is no one standard spacing between the chains in conveyor systems.

To address the above issues related to plastic pallets, a transport system (or system) 100 is shown in FIGS. 1A-1B and 2A-2C. The system 100 includes a pallet 110, formed from a first material, e.g., a plastic. The pallet 110 extends downwardly, heightwise (e.g., in the heightwise direction) 120, from a pallet top deck 130 to a pallet bottom deck 140 to define a pallet height. The pallet 110 extends lengthwise (e.g., in the lengthwise direction) 150 from a pallet forward end 160 to a pallet aft end 170 to define a pallet length. The pallet extends widthwise (e.g., in the widthwise direction) 180 from a pallet first side 190 to a pallet second side 200 to define a pallet width.

Figure 2B:
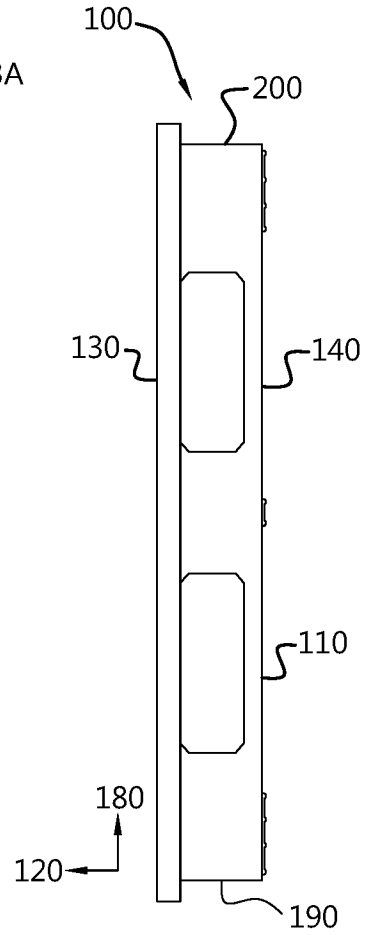
FIG. 2B shows a side view of a pallet according to an embodiment.
Figure 2A:
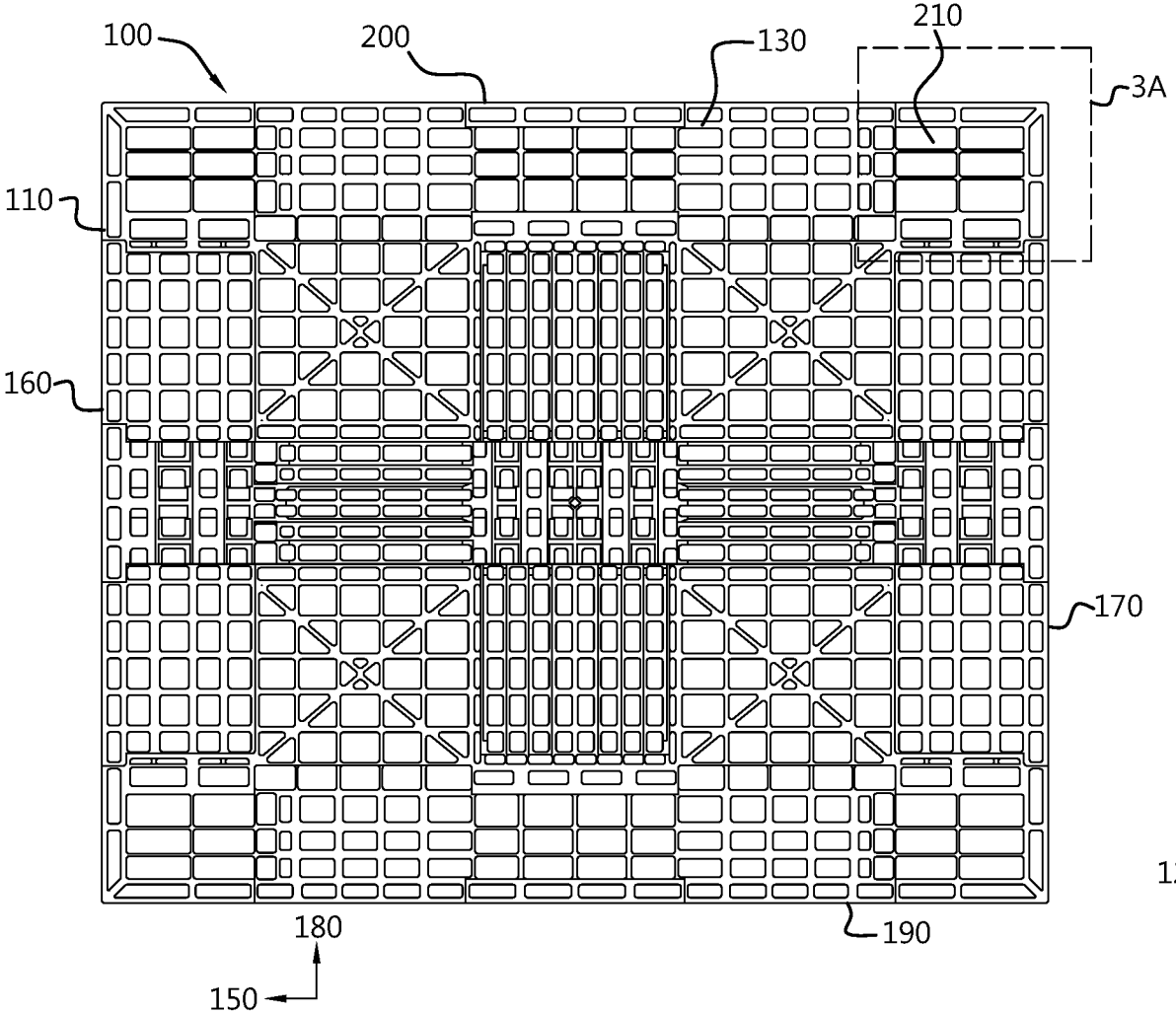
FIG. 2A shows a top view of a pallet according to an embodiment.
Figure 2C:
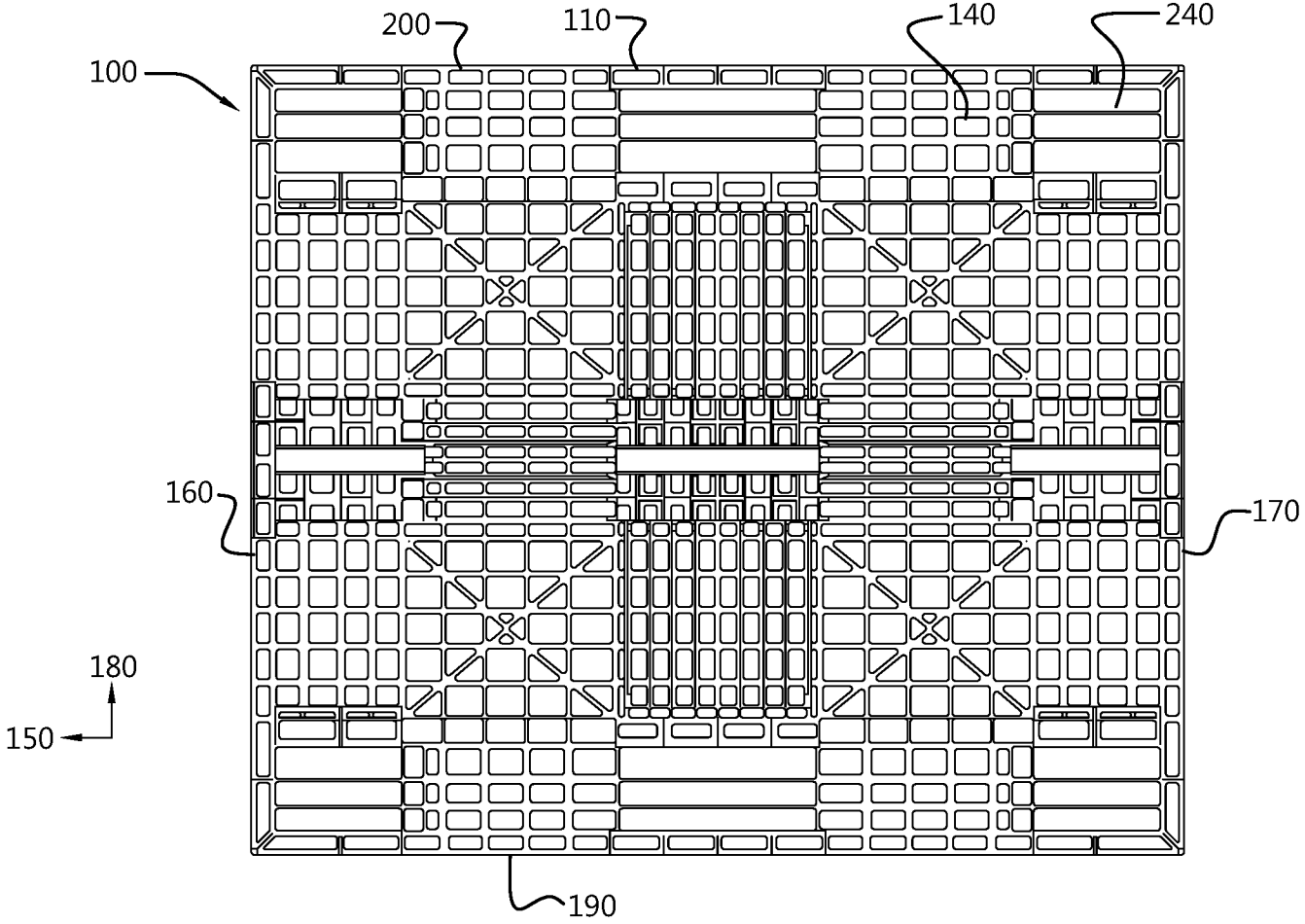
FIG. 2C shows a bottom view of a pallet with pads located in pockets formed in the pallet according to an embodiment.
Figure 3A:
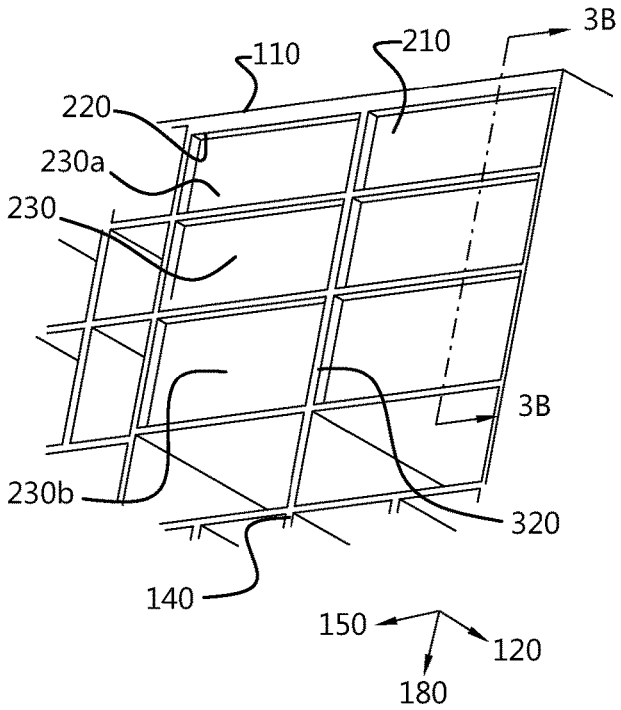
FIG. 3A is a view of section 3A, identified in FIG. 2A, of the pallet.
Figure 3B:
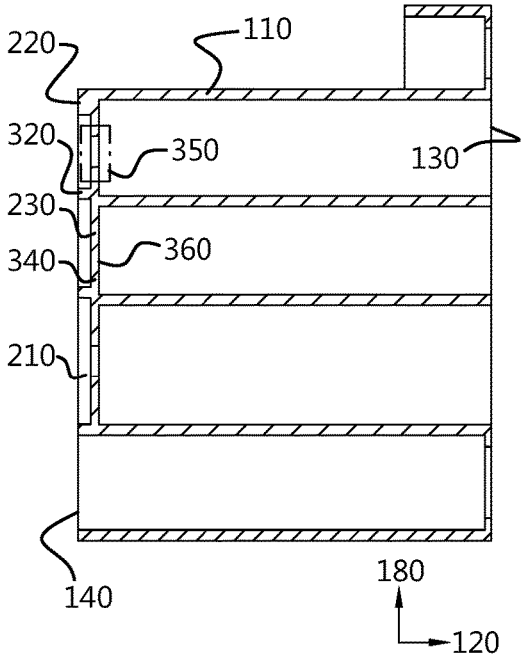
FIG. 3B is a view of section 3B, identified in FIG. 3A, of the pallet.
Figure 4:
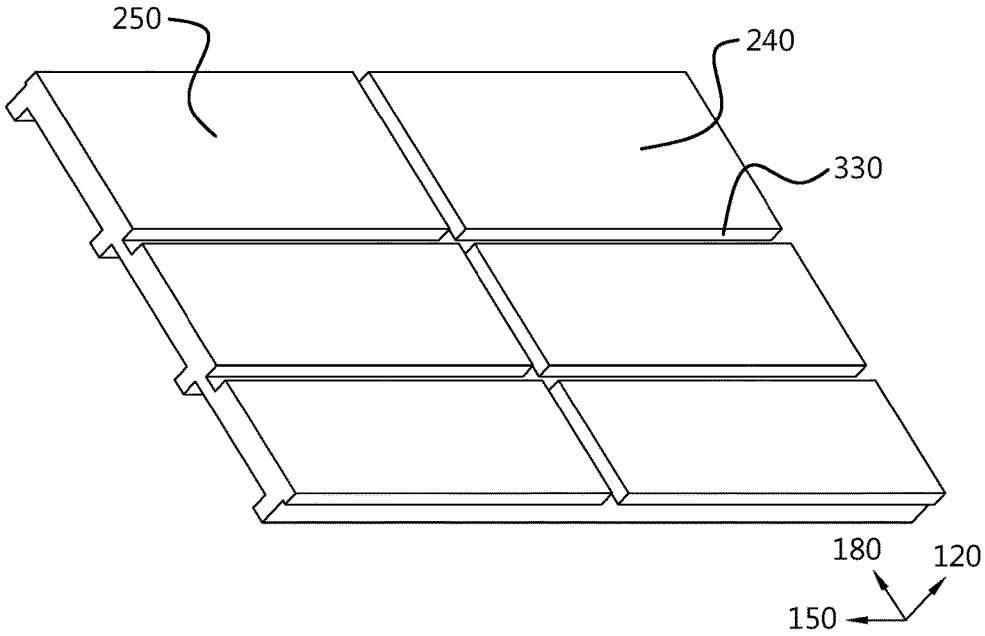
FIG. 4 is a bottom perspective view of the pad according to an embodiment.

As shown in FIG. 2A, and more clearly in FIGS. 3A-3B, the pallet bottom deck 140 defines a pocket (generally referred to as 210). The pocket 210 defines a pocket sidewall 220 that extends heightwise 120 into the pallet 110, from the pallet bottom deck 140 to a pocket base 230 to define a pocket height. As shown in FIGS. 2B and 4, and discussed in greater detail below, a pad (generally referred to as 240), formed of a second material, such as an elastomer, is removably secured within the pocket 210. The pad 240 has a complementary shape to the pocket 210 and the pad 240 defines a pallet foot. In one embodiment, the pad 240 is configured for a friction fit within the pocket 210, while in other embodiments a press fit secures the pad 240 to the pocket (e.g., FIG. 6A, discussed below). In one embodiment, the pallet bottom deck 140 is formed to be quarter symmetric in that the bottom deck 140 is symmetric about lengthwise and widthwise bisecting axes.

Turning back to FIGS. 3A-3B, pocket ribs 320 extend downwardly, heightwise 120, from the pocket base 230 toward the pallet bottom deck 140. The pocket ribs 320 form a grid that divides the pocket base 230 into pocket grid sections 230*a*, 230*b*. Though six pocket grid sections are shown in FIG. 3A, arranged in three widthwise rows of the pocket grid sections (with two pocket grid sections in each row), two pocket grid sections 230*a*, 230*b* are labeled for simplicity. The pocket ribs 320 are configured to engage pad grooves 330 (FIG. 4) formed in a pad top surface 250 of the pad 240. In one embodiment, the pocket grid sections 230*a*, 230*b* have a same size as each other. In one embodiment, ones of the pocket grid sections 230*a*, 230*b* that are adjacent to either of the pallet first side 190 or pallet second side 200 are narrower than others of the pocket grid sections 230*a*, 230*b*. In another embodiment, ones of the pocket grid sections 230*a*, 230*b* that are further from either of the pallet first side 190 or pallet second side 200 are narrower than others of the pocket grid sections 230*a*, 230*b*. In a further embodiment, in the widthwise direction, the widthwise rows of the pocket grid sections may be consecutively larger relative to each other. In such embodiment, the widthwise inner row (closer to the widthwise center of the pallet) of the pocket grid sections may be the narrowest of the widthwise rows of the pocket grid sections.

As shown in FIG. 3B, the pocket base 230 of the pocket 210 defines a pocket base bottom 340 that faces downwardly, heightwise 120, toward the pallet bottom deck 140. The pocket base 230 defines a pocket base body 350 that extends upwardly, heightwise 120, by a pocket base thickness from the pocket base bottom 340 to a pocket base top 360. The pocket base top 360 is orientated to face upwardly, heightwise 120, toward the pallet top deck 130. The pocket base bottom 340 is configured to engage the pad top surface 250 (FIG. 4) when the pad 240 is removably secured within the pocket 210.

Figure 5A:
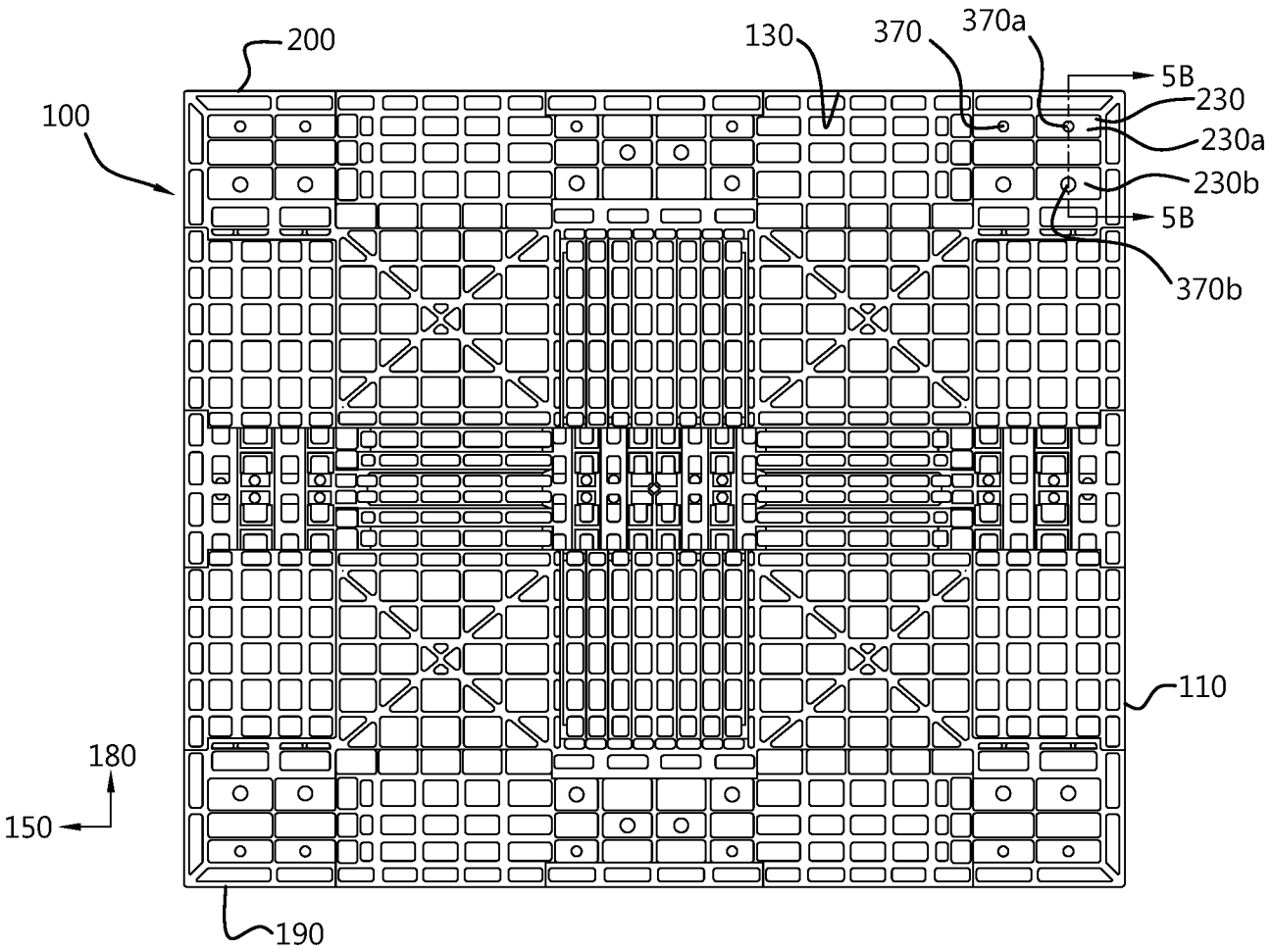
FIG. 5A is a top view of an embodiment of the pallet, where the pockets are formed with fastener channels.
Figure 5B:
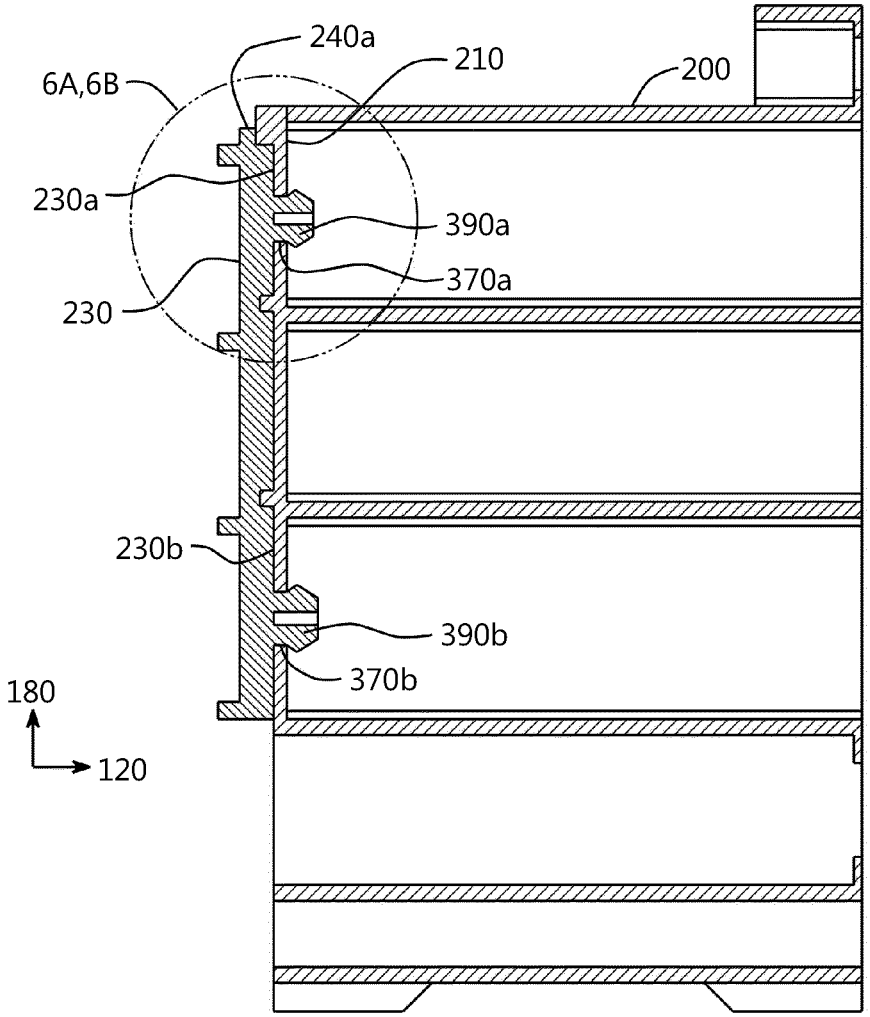
FIG. 5B is a cross sectional view of the pallet along section lines 5B-5B identified in FIG. 5A, and identifies sections 6A and 6B, described below.
Figure 6A:
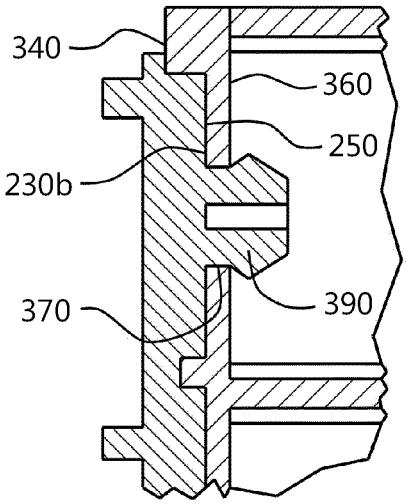
FIG. 6A shows a section of the pallet pocket, with a pad in the pocket.
Figure 6B:
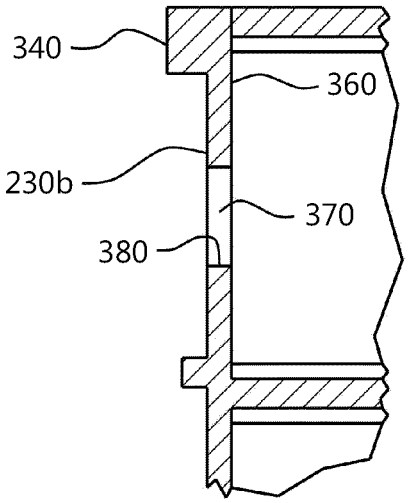
FIG. 6B is a section of the pallet pocket, without a pad in the pocket.

Turning to FIGS. 5A-5B, and more clearly in 6A-6B, the pocket base 230 defines a fastener channel (shown in FIG. 6B and generally referred to as 370). The fastener channel 370 is defined by a fastener channel sidewall 380 (FIG. 6B) that extends upwardly, heightwise 120, from the pocket base bottom 340 to the pocket base top 360, to define a fastener channel height. In one embodiment, the fastener channel 370 is cylindrical to define a fastener channel diameter. The fastener channel 370 is configured to be resiliently engaged by a dimple or fastener boss (generally referred to as 390) that extends upwardly, heightwise 120, from the pad top surface 250 (FIG. 6A). As indicated below, the fastener boss 390 is conformingly shaped for the friction fit within the fastener channel 370.

As further shown in FIGS. 5A-5B, a plurality of the fastener channels (e.g., first and second fastener channels) 370*a*, 370*b* are respectively formed in ones of the pocket grid sections 230*a*, 230*b*. At least two of the fastener channels 370*a*, 370*b* have fastener channel diameters that differ from each other. Ones of the fastener channels 370*a*, 370*b* that are adjacent to either of the pallet first side 190 or pallet second side 200 have smaller fastener channel diameters than others of the fastener channels 370*a*, 370*b*. For example, as shown in FIG. 5A, the first fastener channel 370*a*, which is closer to the pallet second side 200 than the second fastener channel 370*b* has a smaller fastener channel diameter than the second fastener channel 370*b*. In one embodiment, the opposite configuration is provided, so that ones of the fastener channels 370*a*, 370*b* that are further from either of the pallet first side 190 or pallet second side 200 have smaller fastener channel diameters than others of the fastener channels 370*a*, 370*b*. In another embodiment, all of the fastener channels 370*a*, 370*b* have a same size as each other. In one embodiment, a differential in size between the fastener channels 370*a*, 370*b* is proportional to a difference in size between the pocket grid sections 230*a*, 230*b*.

The fastener channels 370*a*, 370*b* are respectively configured to be resiliently engaged by a plurality of the fastener bosses (e.g., first and second fastener bosses) 390*a*, 390*b* (FIG. 5B) that extend upwardly, heightwise 120, from the pad top surface 250. As indicated below the fastener bosses 390*a*, 390*b* are conformingly shaped for the friction fit within respective ones of the fastener channel 370*a*, 370*b*.

Figure 7A:
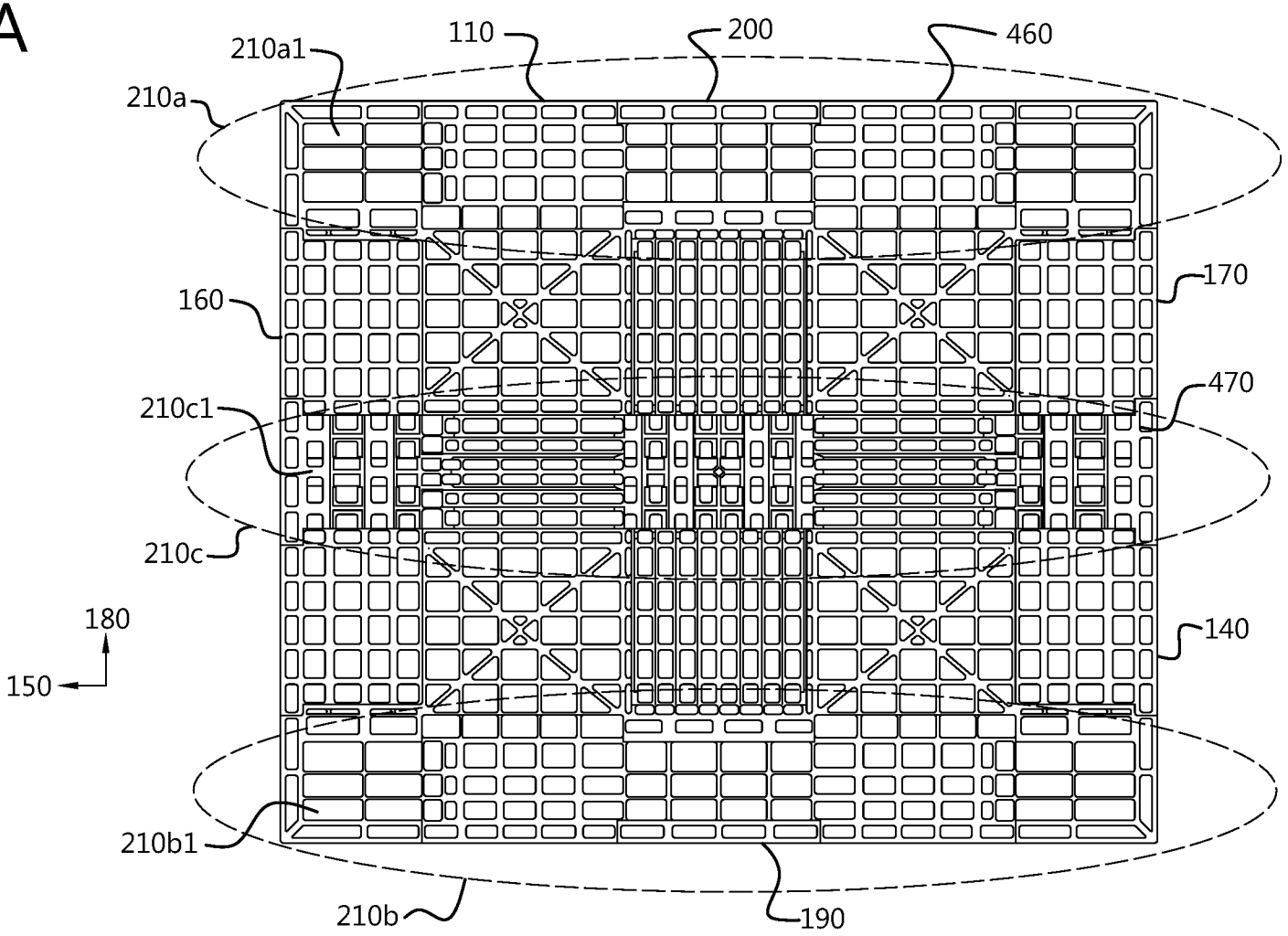
FIG. 7A is a bottom view of the pallet shown in FIG. 1A without pads in the pockets.
Figure 7B:
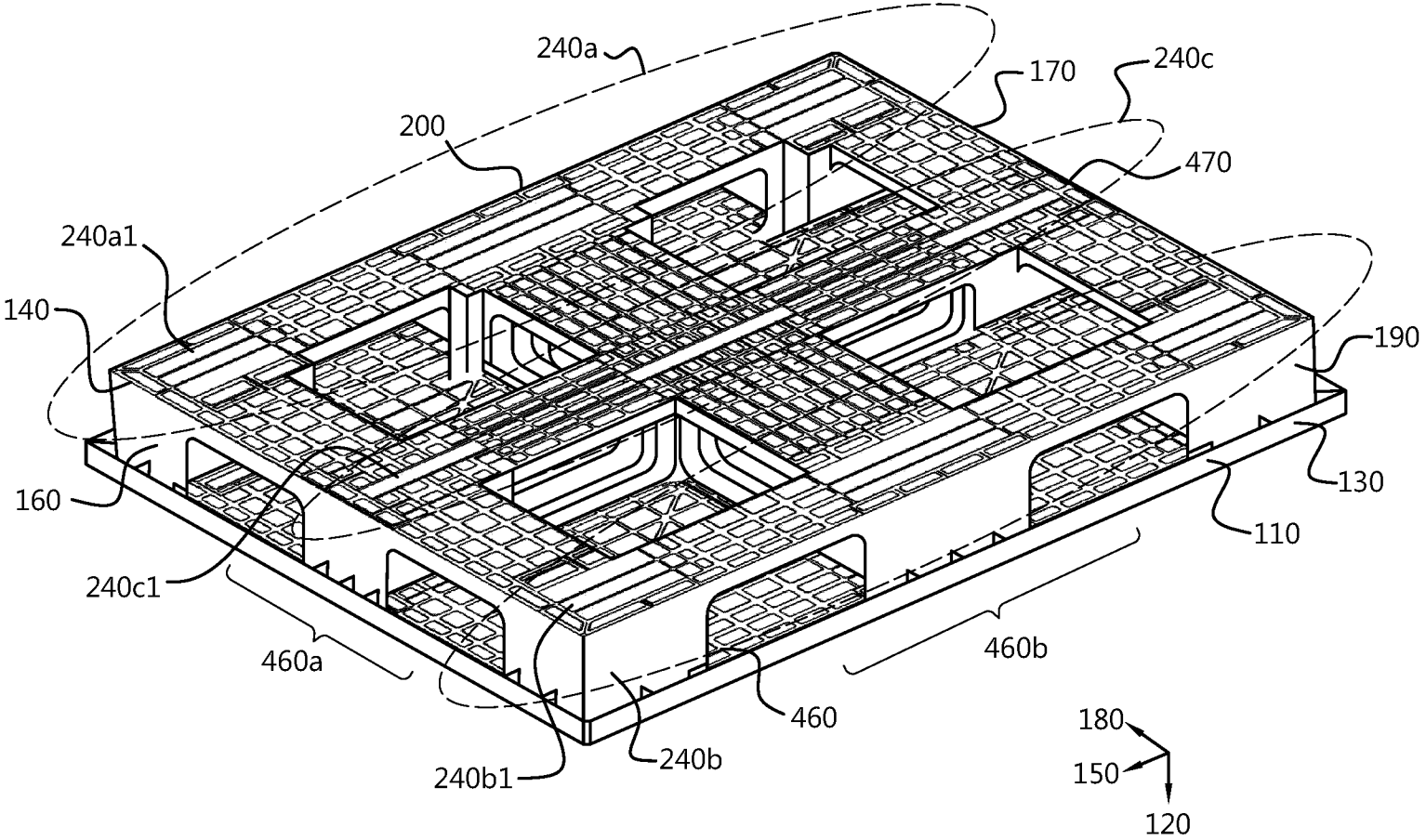
FIG. 7B is a bottom perspective view of the pallet, similar to that shown in FIG. 1B.

Turning to FIGS. 7A-7B, the pallet 110 defines a fork entryway grid 460 between the pallet top and bottom decks 130, 140. The fork entryway grid 460 defines a first set of fork entryways 460*a* (FIG. 7B) that extend lengthwise 150 from the pallet forward end 160 to the pallet aft end 170. The fork entryway grid 460 also defines a second set of fork entryways 460*b* (FIG. 7B) that extend widthwise 180 from the pallet first side 190 to the pallet second side 200.

As shown in FIG. 7A, respectively along the pallet first side 190 and the pallet second side 200, first and second sets of the pockets 210*a*,210*b* are distributed lengthwise 150 so as to be located forward, between and aft of the second set of fork entryways 460*b*. The first and second sets of the pockets 210*a*-210*b* are offset widthwise 180 from the first set of fork entryways 460*a*. With this configuration, as shown in FIG. 7A, the first and second sets of the pockets 210*a*, 210*b* each have three pockets distributed lengthwise 150 along the pallet 110. For example, at the pallet forward end 160, a first pocket 210*a*1 is included in the first set of the pockets 210*a* and a second pocket 210*b*1 is included in the second set of the pocket 210*b*. Each of the pockets in the first and second sets of the pockets 210*a*, 210*b* has a same widthwise size as each other.

The first and second sets of the pockets 210*a*, 210*b* are respectively configured to receive first and second sets of the pads 240*a*-240*b* (FIG. 7B). For example, at the pallet forward end 160, a first pad 240*a*1 is included in the first set of the pads 240*a* and a second pad 240*b*1 is included in the second set of the pads 240*b*. The first and second sets of the pads 240*a*,240*b* are respectively shaped to conform with the first and second sets of the pockets 210*a*, 210*b* so as to friction fit within the pockets 210*a*, 210*b*.

Turning back to FIG. 7A, in one embodiment, along a center portion 470 of the pallet 110, a third set of the pockets 210*c* is distributed lengthwise 150 so as to be located forward, between and aft of the first set of fork entryways 460*b* and widthwise offset from the first set of fork entryways 460*a*. The third sets of pockets 210*c* has three of the pockets, distributed lengthwise 150 along the pallet 110 and having a same widthwise size as each other. For example, at the pallet forward end 160, a third pocket 210*c*1 is included in the third set of pockets 210*c*. As shown in FIG. 7B, the third set of the pockets 210*c*1 are respectively configured to receive a third set of the pads 240*c*. For example, at the pallet forward end 160, a third pad 240*c*1 is included in the third set of the pads 240*c*. The third set of the pads 240*c* are shaped to conform with the third sets of the pockets 210*c* so as to friction fit within the pockets 210*c*.

In one embodiment, the first and second sets of the pockets 210*a*, 210*b* are wider than the third set of the pockets 210*c*. As a result, the first and second sets of the pads 240*a*, 240*b* are wider than the third set of the pads 240*c*. From this configuration, the pallet 110 is configured for placement over different chain conveyers respectively configured with chains at differing widthwise locations.

Turning to FIGS. 8A-8E the pad 240 will be disclosed in further detail. The pad 240 can include the pad top surface 250, e.g., facing upwardly, heightwise 120, when the pad 240 is installed in the pocket 210 (e.g., FIG. 5B). The pad 240 can extend downwardly, heightwise 120, from the pad top surface 250 to a pad bottom surface 260 (or pad base) to define a pad height (or pad thickness). The pad 240 can extend lengthwise 150 from a pad forward end 262 to a pad aft end 264 to define a pad length. The pad 240 can extend widthwise 180 from a pad first side 266 to a pad second side 268 to define a pad width. The pad 240 can have a height (or thickness) such that that the pad bottom surface 260 rides on a chain of a chain conveyer when the pallet 110 is placed on the conveyer with the pad 240 over the chain.

Figure 8A:
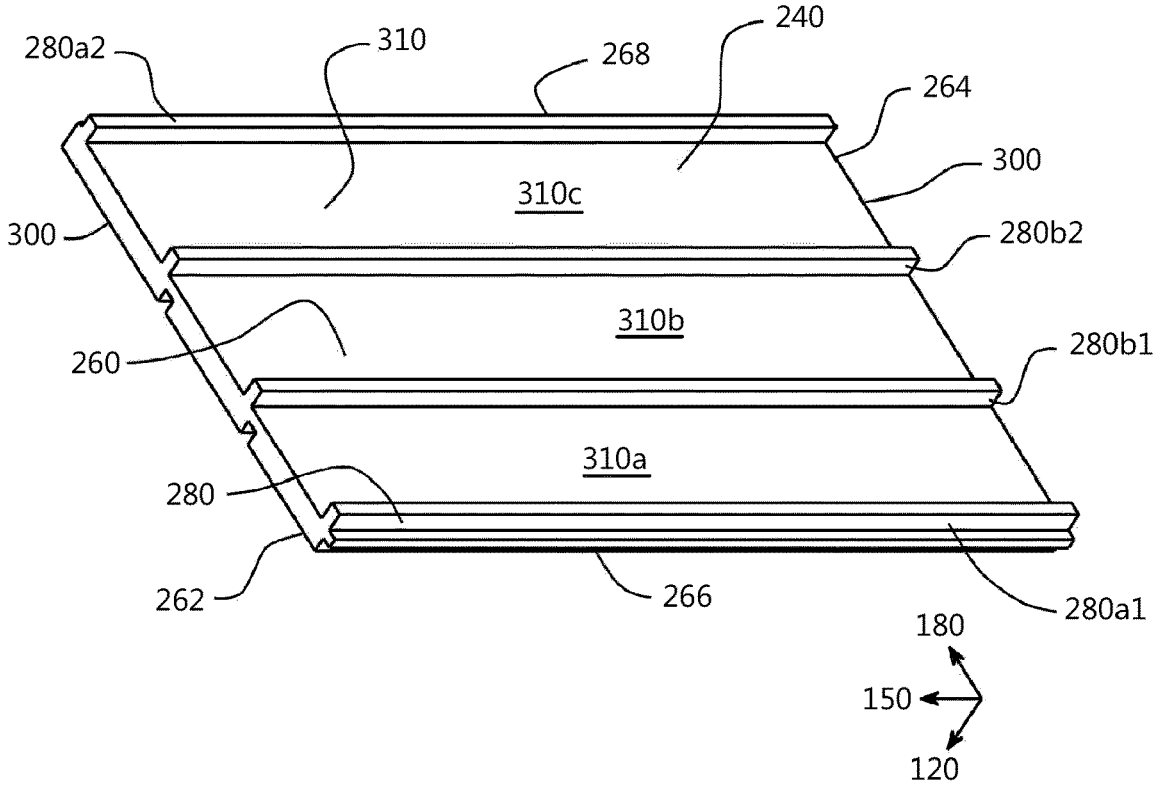
FIG. 8A is a bottom perspective view of the pad shown in FIG. 4.

Pad ribs (generally referred to as 280) can extend downwardly, heightwise 120, from the pad bottom surface 260. The pad ribs 280 can extend lengthwise 150 from the pad forward end 262 to the pad aft end 264. The pad ribs 280 can be spaced widthwise 180 from each other so that adjacent pairs of the pad ribs respectively define a chain receiving track (generally referred to as 310) therebetween. As shown in FIG. 8A, the pad 110 defines three of the chain receiving tracks 310*a*-310*c* that are adjacent, widthwise 180, to each other. Four of the pad ribs that define the chain receiving tracks 310*a*-310*c* include a pair of widthwise outer pad ribs 280*a*1, 280*a*2 and a pair of widthwise intermediate pad ribs 280*b*1, 280*b*2. In one embodiment, the widthwise intermediate pad ribs 280*b*1, 280*b*2 (i.e., intermediate ones of the pad ribs 280) can have a same or less span, widthwise 180 (e.g., can be as thick or thinner), than the widthwise outer pad ribs 280*a*1, 280*a*2 (i.e., outer ones of the pad ribs 280).

That is, the intermediate pad ribs 280*b*2, 280*b*2 can be designed with a higher stiffness, and thus they can be formed thinner than the outer pad ribs 280*a*1, 280*a*2.

Figure 8B:
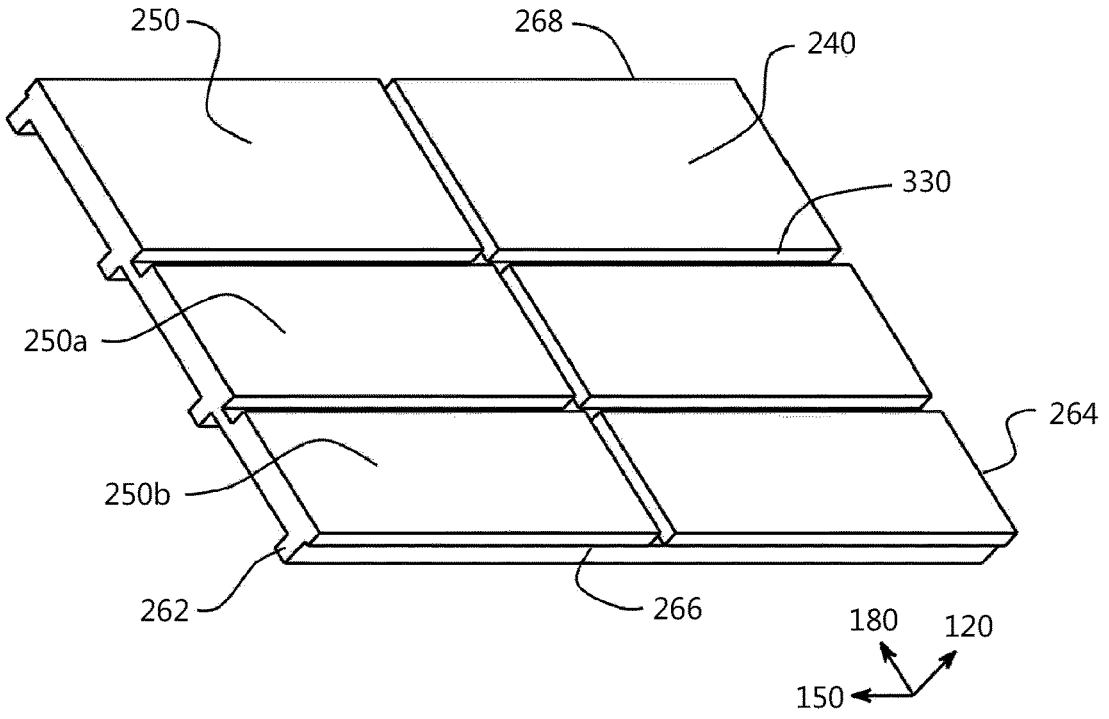
FIG. 8B is a bottom perspective view of the pad, similar to that shown in FIG. 4.
Figure 8C:
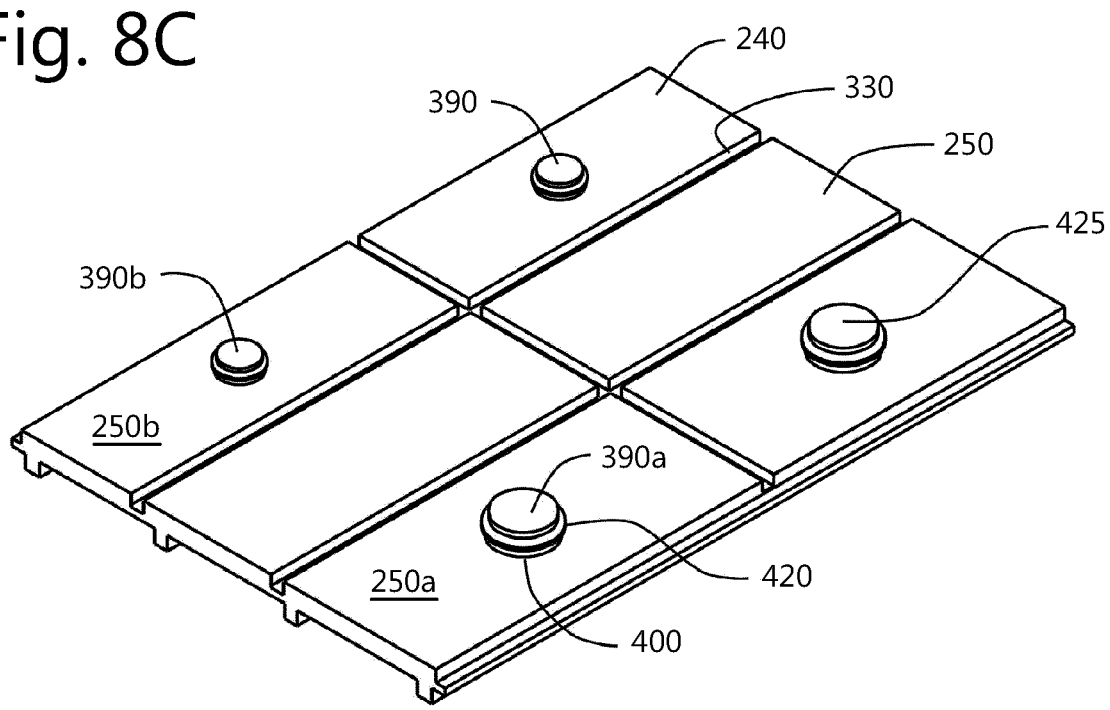
FIG. 8C is a bottom perspective view of the pad according to an embodiment where dimples are provided along the bottom of the pad.
Figure 8D:
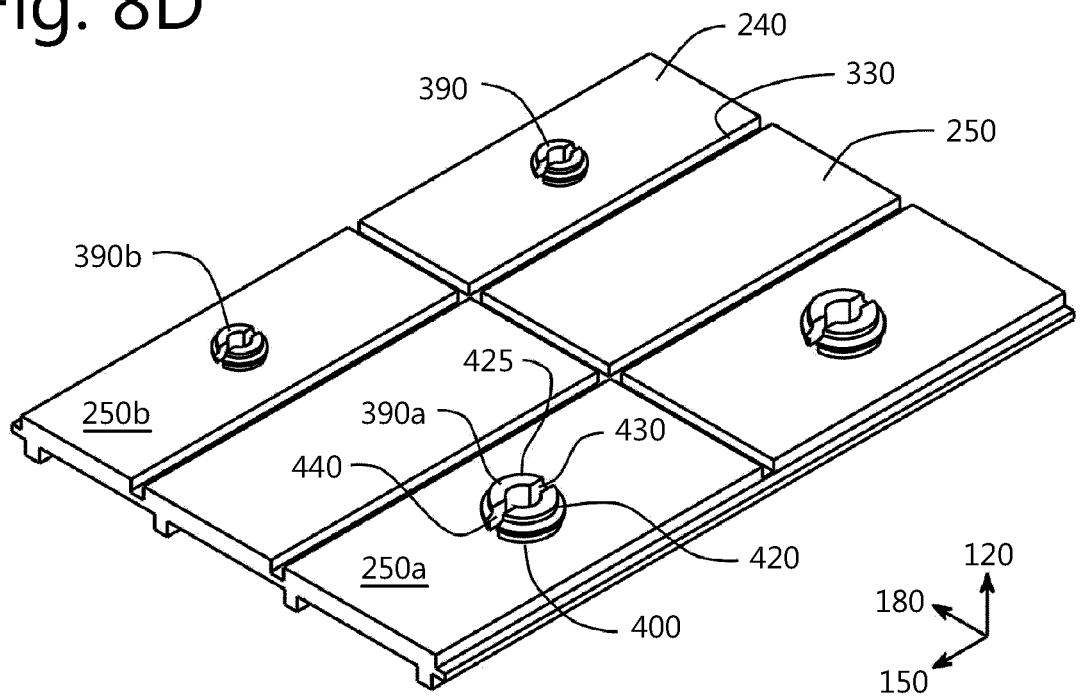
FIG. 8D is a bottom perspective view of the pad according to an embodiment where slots are provided through the dimples.

As shown in FIGS. 8B-8D, the pad top surface 250 defines the pad grooves 330 that extend downwardly, heightwise 120, into the pad 240. The pad grooves 330 divide the pad top surface 250 into pad grid sections 250*a*, 250*b*, configured to the engage pocket ribs 320 that extend downwardly, heightwise 120, from the pocket 210 of the pallet 110 (FIGS. 3A-3B). Though six pad grid sections are shown in FIG. 8B, two pad grid sections 250*a*, 250*b* are labeled for simplicity. In one embodiment, the pad grid sections 250*a*, 250*b* have a same size as each other. In one embodiment, ones of the pad grid sections 250*a*, 250*b* that are adjacent to either of the pad sides 266, 268 are narrower than others of the pad grid sections 250*a*, 250*b*.

Figure 8E:
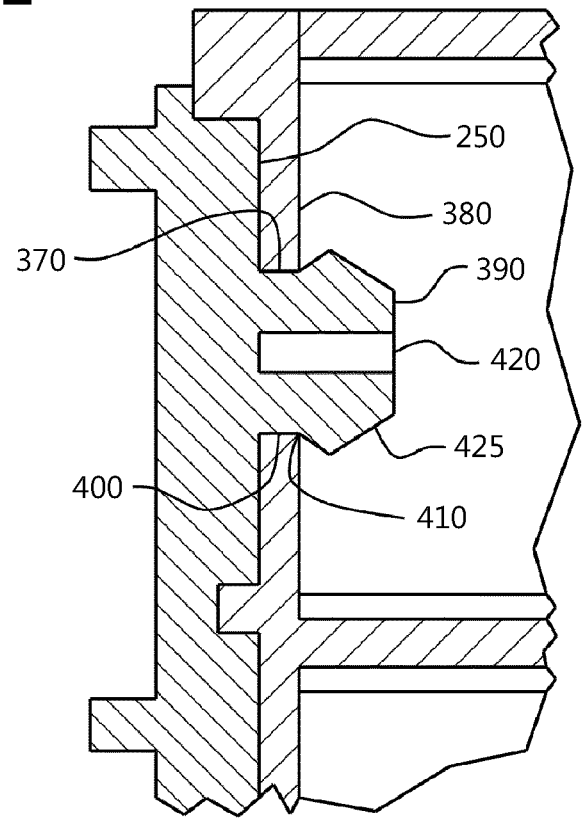
FIG. 8E shows the same aspects shown in FIG. 6A, with features of a fastener boss identified in greater detail.

As shown in FIGS. 8C-8E, the fastener boss 390 extends upwardly, heightwise 120, from the pad top surface 250. The fastener boss 390 defines a boss neck 400 having a cylindrical shape that defines a neck diameter. The boss neck 400 extends heightwise 120 from the pad top surface 250 to a boss neck top end 410 (FIG. 8E) by a neck height. The neck height is the same as the height of the fastener channel 370, i.e., the heightwise span of the fastener channel sidewall 380 (FIG. 6B).

An anchor head 420 is formed at the boss neck top end 410. The anchor head 420 defines an annulus having a diameter that is larger than the fastener channel diameter. The anchor head 420 extends heightwise 120 from the boss neck top end 410 to an anchor head top end 425 by an anchor head height. The anchor head 420, which can be pan shaped, can be a flat annulus, or can have another such shape, is configured to elastically deform and rebound, enabling it to pass through the fastener channel 370 and rebound against the pocket base top 360 (FIG. 6A).

As shown in FIG. 8D, the fastener boss 390 defines a boss slot 430 that extends through the boss neck 400 and anchor head 420. The boss slot 430 is defined by a boss slot wall 440 extending upwardly, heightwise 120, and front to back, lengthwise 150, from the pad top surface 250 to the anchor head top end 425. From this configuration, the anchor head 420 is configured to elastically compress when inserted into the fastener channel for inserting and removing the pad 240 from the pallet 110.

As shown in FIGS. 8C and 8D, a plurality of the fastener bosses 390*a*, 390*b* are respectively formed in the pad grid sections 250*a*, 250*b*. At least two of the fastener bosses 390*a*, 390*b* have differing neck diameters, respectively conforming with the diameters of the fastener channel 370*a*, 370*b* in which the fastener bosses 390*a*, 390*b* are inserted. The anchor head 420 is sized proportionally to the neck diameters. For example, ones of the fastener bosses 390*a*, 390*b* that are adjacent to either of the pallet first or second sides 190, 200, when inserted into, e.g., the pocket 210, have a smaller neck diameter than others of the fastener bosses 390*a*, 390*b*. For example, in FIGS. 8C and 8D, the first fastener boss 390*a* has a larger neck diameter than the second fastener boss 390*b*. In one embodiment, the opposite configuration is provided, e.g., such that ones of the fastener bosses 390*a*, 390*b* that are further from either of the pallet first or second sides 190, 200, when inserted into, e.g., the pocket 210, have a smaller neck diameter than others of the fastener bosses 390*a*, 390*b*. In another embodiment, all of the fastener bosses 390*a*, 390*b* have the same size as each other.

Figure 9:
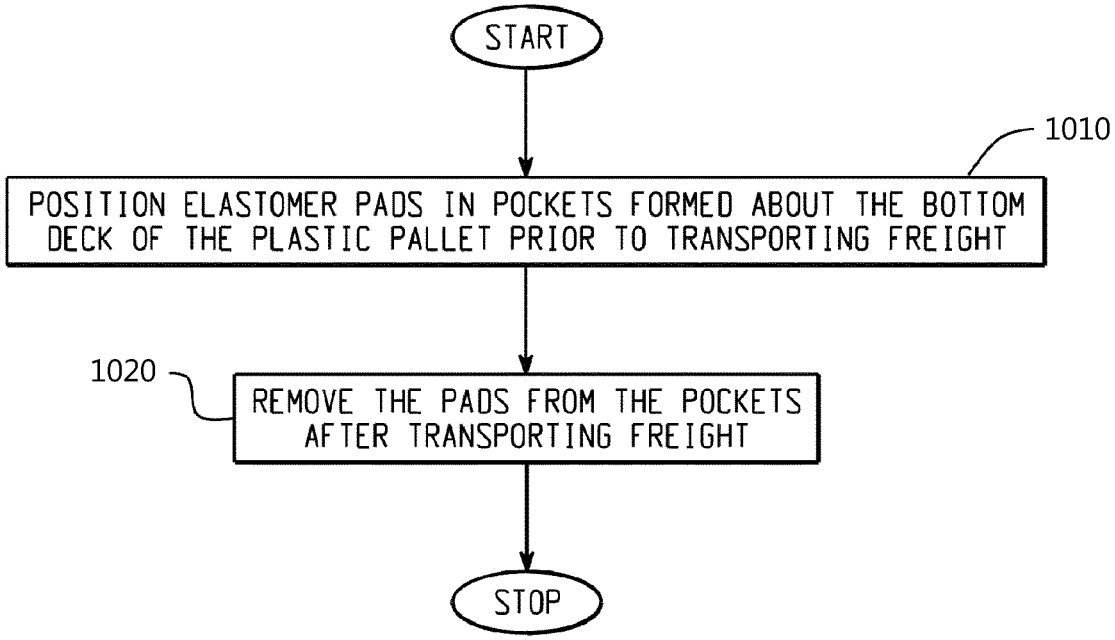
FIG. 9 is a flowchart showing a method of utilizing the pallet according to an embodiment.

Turning to FIG. 9, further disclosed is a method of utilizing the pallet 110 for transporting freight via a chain conveyor system. As shown in block 1010 of positioning the elastomer pads 240 in pockets 210 formed about the bottom deck 140 of the plastic pallet 110 prior to transporting freight. As shown in block 1020, the method includes removing the pads 240 from the pockets 210 of the pallet 110 after transporting freight.

Figure 10A:
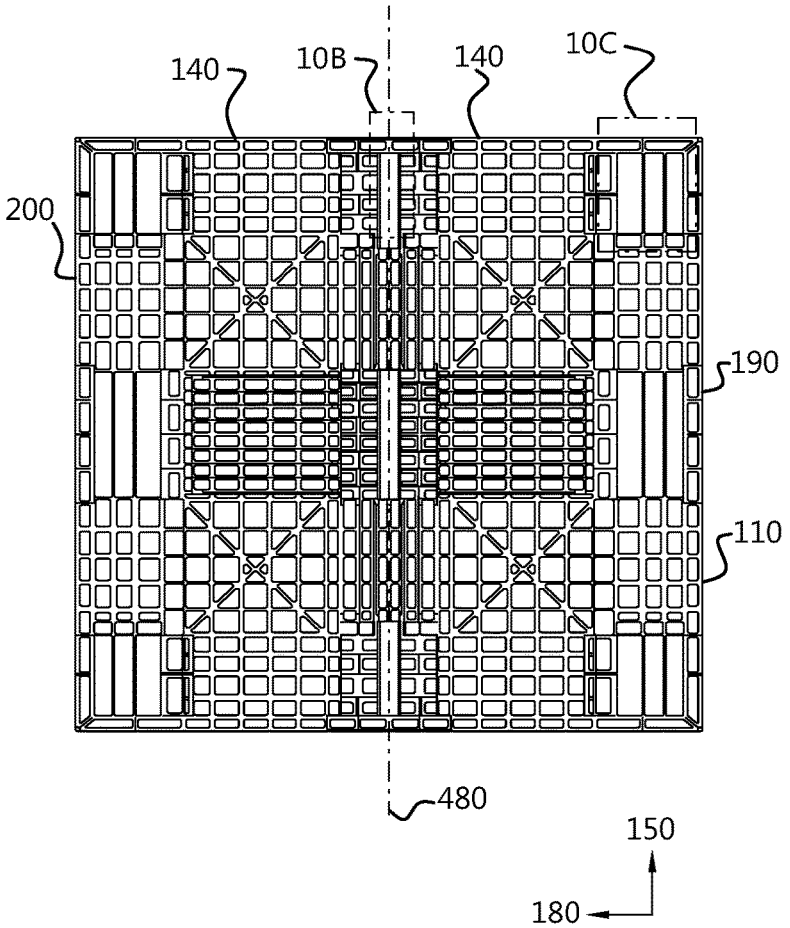
FIG. 10A is a bottom view of the pallet with pads, similar to FIG. 2C, and identifies sections 10B and 10C, described below.
Figure 10B:
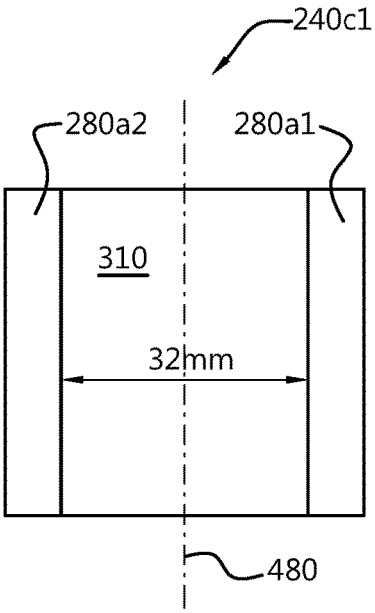
FIG. 10B shows a center pad installed in the pallet as shown in FIG. 10A.
Figure 10C:
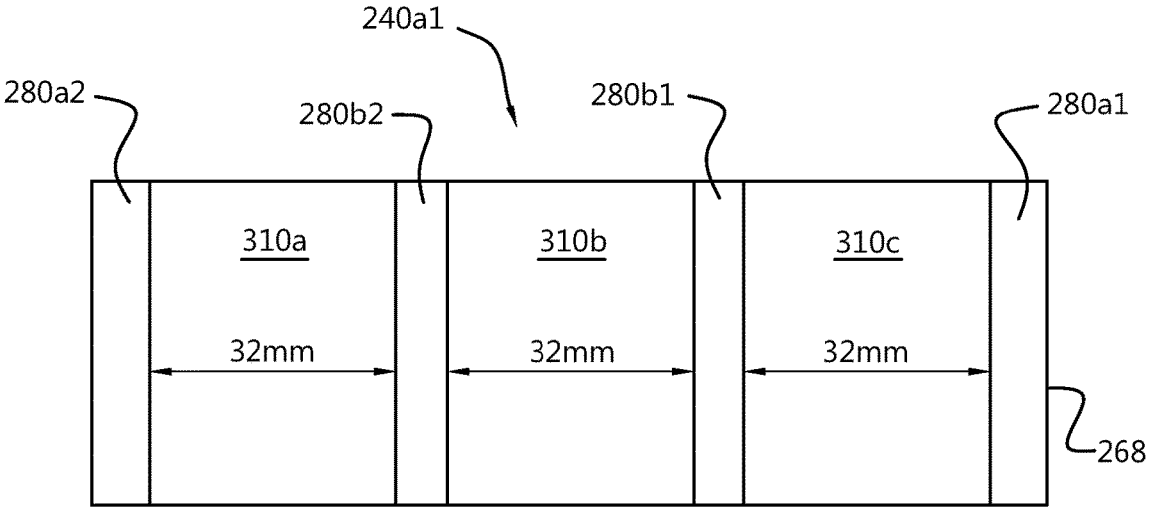
FIG. 10C shows a side pad installed in the pallet as shown in FIG. 10A.

Turning to FIGS. 10A-10C, an example configuration of the pallet bottom deck 140 is shown. The overall span lengthwise 150 of the pallet 110 can be approximately 1300 mm (millimeters), the overall span widthwise 180 can be approximately 1100 mm, and the overall span heightwise 120 (e.g., FIG. 1A) can be approximately 145 mm, and can be 151 mm including the pad ribs 280.

FIG. 10B shows the third pad 240*c*1 of the third set of the pads 240*c*. Widthwise outer pad ribs 280*a*1, 280*a*2 are each 4 mm thick, and a distance between them is 32 mm. Widthwise 180, the remaining pads in the third set of the pads 240*c* are the same as that of the third pad 204*c*1.

In FIG. 10C, the three chain receiving tracks 310*a*-310*c* are shown. Widthwise outer pad ribs 280*a*1, 280*a*2 are each 4 mm thick while widthwise inner pad ribs 280*b*1, 280*b*2 are each 3 mm thick (though in another embodiment they can be the same width as the outer pad ribs). A distance between each pair of pad ribs is 32 mm. A distance between a centerline 480 that extends lengthwise 150 through the pallet 110 to an inside of the first pad rib 280*a*2 (e.g., facing the first chain receiving track 310*a*) is 406 mm. A distance between the centerline 480 to an inside of the second pad rib 280*b*2 (e.g., facing the second chain receiving track 310*b*) is 441 mm. A distance between the centerline 480 to an inside of the third pad rib 280*b*1 (e.g., facing the third chain receiving track 310*c*) is 476 mm. Widthwise 180, the remaining pads in the first set of the pads 240*a* (FIG. 7B) are the same as that of the first pad 204*a*1. This design accounts for two common chain conveyor configurations with the first and second chain receiving tracks 310*a*, 310*b*, where the distance is 406 mm and 441 mm. The third chain receiving track 310*c* track can accommodate chain configuration having centerline distance from 476 mm to 483.75 mm. For the third chain receiving track 310*c*, a spacing of 483.75 mm is possible by increasing a width (thickness) of the adjacent rib from 3 mm to 10.75 mm, and extending the other end of the chain receiving track rib at the second pad side 286 to the respective pallet side (190 or 200).

The configuration of the second set of pads 240*b* (FIG. 7B) mirrors the first set of the pads 240*a* about the centerline 480. This configuration is configured be utilized with chain tracks in different conveyer systems having at least three different chain conveyor layouts. In the above disclosed embodiments, the pads 240 can be installed and removed as needed. Thus, for example if a pallet 110 becomes damaged, the pads 240 can be interchangeably use with another pallet 110 formed with the pockets 210 identified herein.

The pallet 110 is designed to withstand typical pallet loading requirements. For example, under a 15000 N (Newton) forklift loading, the pallet 110 is configured for deformation of less than 20 mm or bend angel of <4.5 deg. Further, under a 3000 kg stacking loading, the pallet 110 is configured to for deformation of <2%. Additionally, under 15000 N loading, the pallet 110 is configured so that the pads 240 remain secured within the pockets 210.

Figure 11B:
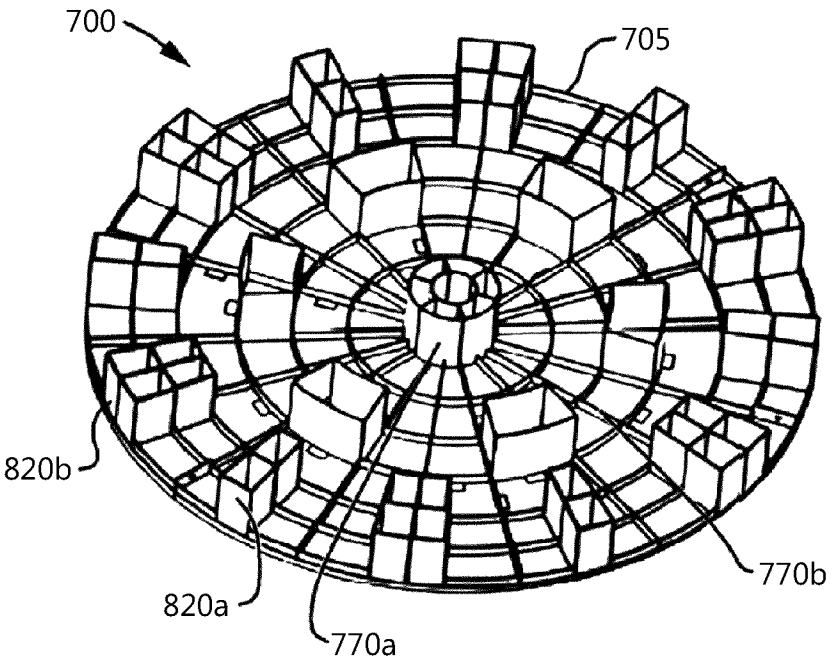
FIG. 11B shows a bottom perspective view of the support pallet of FIG. 11A, according to an embodiment.
Figure 11A:
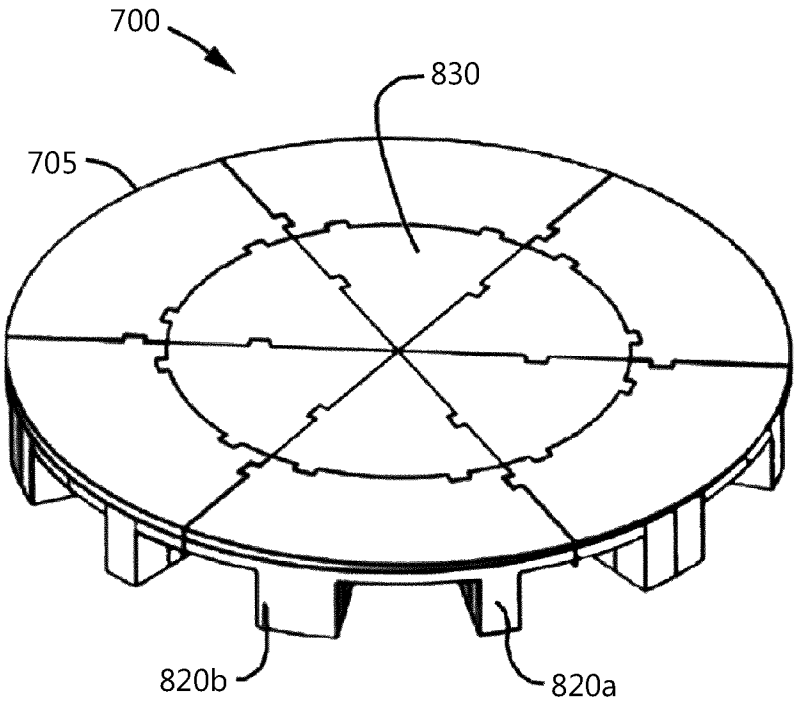
FIG. 11A shows a top perspective view of a support pallet according to an embodiment, where the support pallet has a circular deck.
Figure 11C:
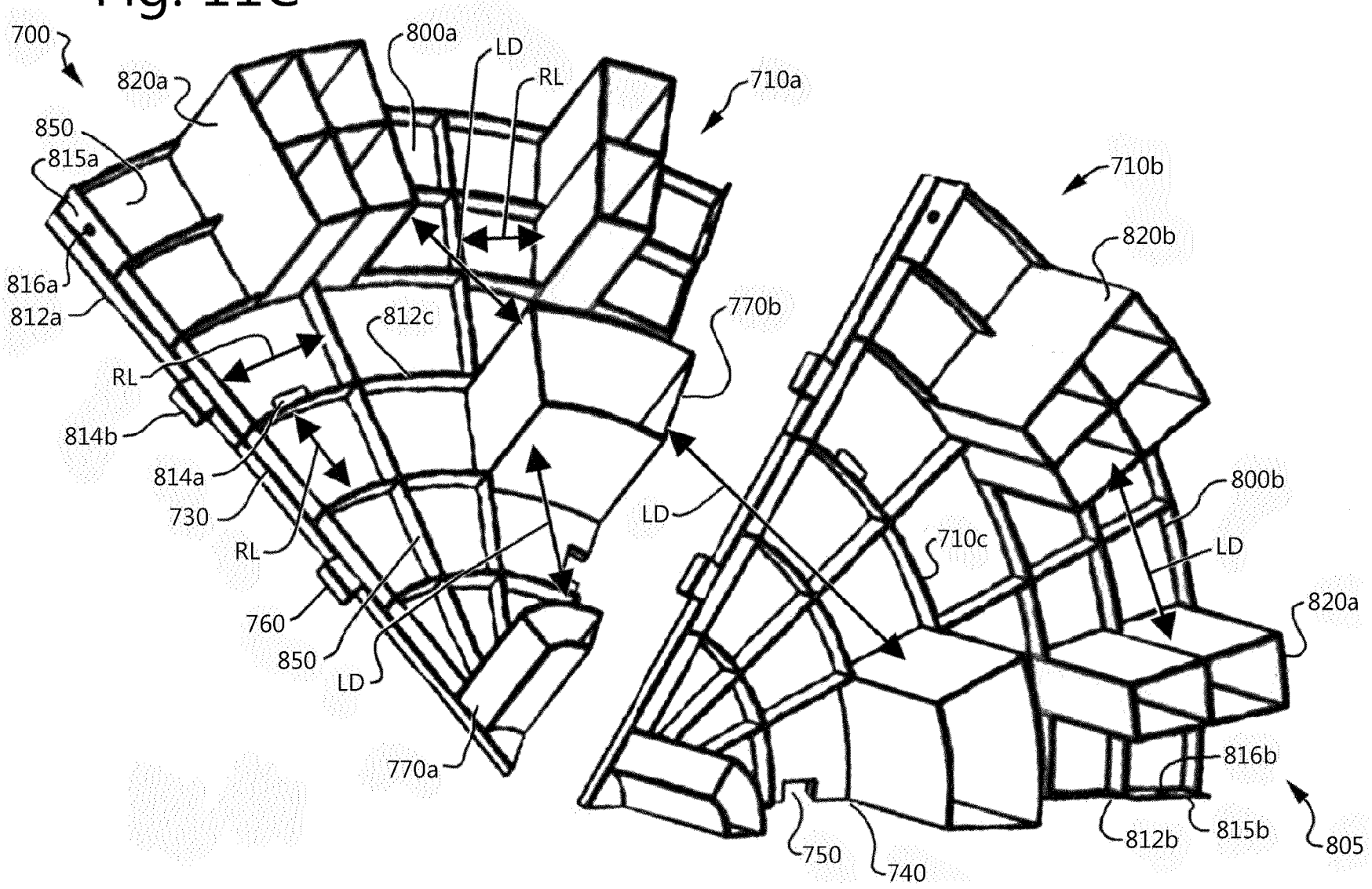
FIG. 11C shows a bottom perspective view of interconnectable portions of the support pallet of FIG. 11A, according to an embodiment.
Figure 11D:
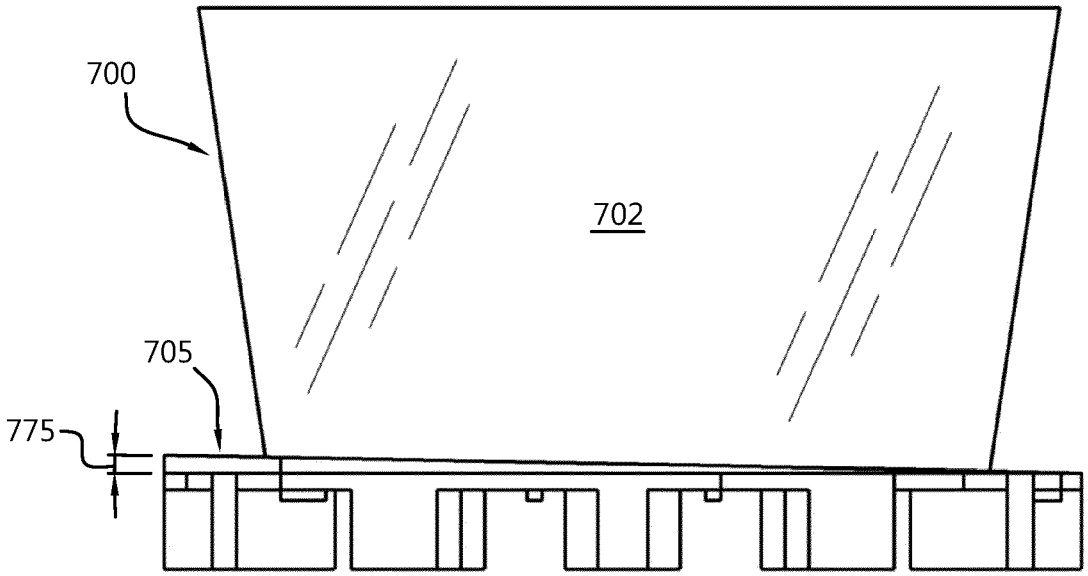
FIG. 11D shows a side view of the support pallet of FIG. 11A, according to an embodiment.
Figure 12:
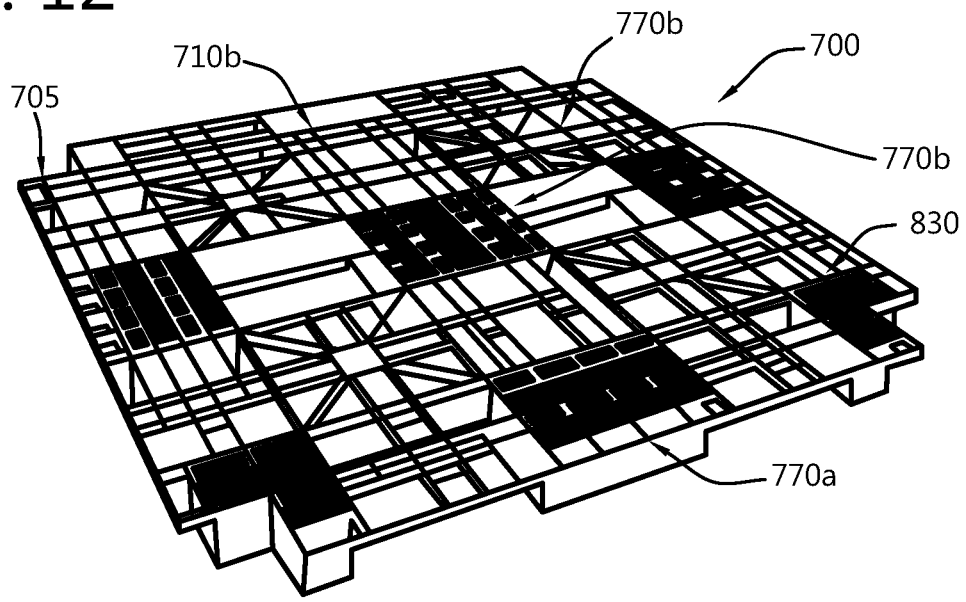
FIG. 12 shows a perspective view of a support pallet according to an embodiment, where the support pallet has a square deck.

Turning to FIGS. 11A-11D and 12, a support system 700 is shown, which represents another pallet embodiment. Specifically, the system 700 includes a primary platform 705 defining a plastic pallet with a circular deck (FIGS. 11A-11D) and a square deck (FIG. 12). As shown in FIG. 11C, the primary platform 705 is formed by primary platform segments 710*a*, 710*b*, that are interconnectable with each other. The primary platform segments 710*a*, 710*b* each include a first side 730 and a second side 740. The first and second sides 730, 740 each define one of notches 750 and tabs 760 to respectively mate with (or dovetail with) corresponding tabs and notches of other ones of the primary platform segments 710*a*, 710*b*. From this configuration, adjacent ones of the primary platform segments 710*a*, 710*b* can be interconnected.

The primary platform segments 710*a*, 710*b* each define primary legs 770*a*, 770*b* extending downwardly from the primary platform segments 710*a*, 710*b*. The legs are shown as being enclosed structures, e.g., formed as exterior shelled structures. The primary legs 770*a*, 770*b* are sized to impart a primary slope 775 (FIG. 11D) along the primary platform 705. The primary slope can be substantially one (1) degree.

Secondary platform segments 800*a*, 800*b* (FIG. 11C) are interconnectable with each other and with the primary platform segments 710*a*, 710*b* to form an extension 805 of the primary platform 705. The secondary platform segments 800*a*, 800*b* each include first and second sides 812*a*, 812*b* and a radial inner side 812*c*. The first and second sides 812*a*, 812*b* and a radial inner side 812*c* each define one of notches 814*a* and tabs 814*b* to respectively mate with (or dovetail with) corresponding tabs and notches of other ones of the secondary platform segments 800*a*, 800*b* and the radial outer edge 710*c* of the primary platform segments 710*a*, 710*b*. The first and second sides 812*a*, 812*b* of the secondary platform segments 800*a*, 800*b* also include mating fastener tabs 815*a*, 815*b* that are radially aligned with each other and include features 816*a*, 816*b*, such as through-holes, that enable the use of screws or other implements to secure the secondary platform segments 800*a*, 800*b* to each other.

The secondary platform segments 800*a*, 800*b* each define secondary legs 820*a*, 820*b* extending downwardly from the secondary platform segments 800*a*, 800*b*, where one of the secondary legs 820*a* can be circumferentially larger than the other 820*b*. The secondary legs 820*a*, 820*b* are sized so that the primary platform 705 and the extension 805 of the primary platform 705 are smoothly continuous and planar with each other, and so that the secondary platform segments 800*a*, 800*b* will not tip under loading conditions. As shown in FIGS. 11A-11C, the primary platform 705 can have a continuous top surface 830. As shown in FIGS. 12, the primary platform 705 can have a discontinuous top surface 830, e.g., allowing water and debris to fall through a beam-type support structure.

In one embodiment, a leg spacing distance (LD) between any of the legs 770*a*, 770*b*, 820*a*, 820*b*, when assembled, is 200 mm to 250 mm. Structural ribs 840 form a grid on the bottom surface 850 of the system, along both the primary and secondary platform segments. A rib length RL of any rib segment in the grid is 80 mm to 130 mm.

The support system of FIGS. 11A-11D and 12 can be utilized to support a water tank 702 (FIG. 11D). The extensions (the secondary platform segments 800*a*, 800*b*) can be utilized to support a relatively large tank. Without the extensions, the system can include 4-6 interconnectable parts. With the extensions, the system can include 8-12 interconnectable parts. The angled top surface can enable water runoff from the water tank, as well as relatively easy cleaning of the tank. The inclination can help avoid an accumulation of dust on a floor of a water tank, helping to eliminate bacteria due to dust decantation. Benefits of a continuous top surface include preventing of water clogging on the support system 700. Benefits of covered/enclosed support legs also include preventing clogging of water inside the support system 700. In one embodiment, the legs are configured such that a four inch pipe can be passed therethrough in straight line, from one end to other, e.g., via up to six path-through directions. An overall shape of the pallet is shown as circular (FIGS. 11A-11D) and square (FIG. 12), though other shapes, including rectangular and hexagonal can be utilized.

A minimum length/diameter of the support system 700 (e.g., excluding extensions) can be 800 mm and a maximum length/diameter (e.g., including extensions) can be 1500 mm. A minimum load carrying capacity of the support system 700 (e.g., excluding extensions) can be 350 L (liters) and a maximum load carrying capacity (e.g., including extensions) can be approximately 1000 L. A minimum weight of the support system 700 (e.g., excluding extensions) can be 7 kg (kilograms) and a maximum weight (e.g., including extensions) can be 13 kg. The square shaped support system 700 (FIG. 12) can be designed such that under a weighting of 12 kg, a maximum displacement of 0.9 mm can be achieved with a stress distribution of 8 MPa (megapascals). The circular shaped support system 700 (FIGS. 11A-11D) can be designed such that under a weighting of 11.5 kg, a maximum displacement of 2.7 mm can be achieved with a stress distribution of 15 MPa.

The pallets identified above can comprise a polymeric material. The polymeric material is chosen based upon the desired properties, such as thermal stability. Examples of polymeric materials include, but are not limited to, polyesters, polycarbonates, polystyrenes (e.g., copolymers of polycarbonate and styrene, polyphenylene ether-polystyrene blends), polyimides (e.g., polyetherimides), acrylonitrile-styrene-butadiene (ABS), polyarylates, polyalkylmethacrylates (e.g., polymethylmethacrylates (PMMA)), polyolefins (e.g., polypropylenes (PP) and polyethylenes, high density polyethylenes (HDPE), low density polyethylenes (LDPE), linear low density polyethylenes (LLDPE)), polyamides (e.g., polyamideimides), polyarylates, polysulfones (e.g., polyarylsulfones, polysulfonamides), polyphenylene sulfides, polytetrafluoroethylenes, polyethers (e.g., polyether ketones (PEK), polyether etherketones (PEEK), polyethersulfones (PES)), polyacrylics, polyacetals, polybenzoxazoles (e.g., polybenzothiazinophenothiazines, polybenzothiazoles), polyoxadiazoles, polypyrazinoquinoxalines, polypyromellitimides, polyquinoxalines, polybenzimidazoles, polyoxindoles, polyoxoisoindolines (e.g., polydioxoisoindolines), polytriazines, polypyridazines, polypiperazines, polypyridines, polypiperidines, polytriazoles, polypyrazoles, polypyrrolidones, polycarboranes, polyoxabicyclononanes, polydibenzofurans, polyphthalamide, polyacetals, polyanhydrides, polyvinyls (e.g., polyvinyl ethers, polyvinyl thioethers, polyvinyl alcohols, polyvinyl ketones, polyvinyl halides, polyvinyl nitriles, polyvinyl esters, polyvinylchlorides), polysulfonates, polysulfides, polyureas, polyphosphazenes, polysilazanes, polysiloxanes, fluoropolymers (e.g., polyvinyl fluoride (PVF), polyvinylidene fluoride (PVDF), polyvinyl fluoride (PVF), fluorinated ethylene-propylene (FEP), polyethylene tetrafluoroethylene (ETFE)), polycarbonate-siloxane block copolymer (such as LEXAN® EXL Resin), terephthalate ester of resorcinol (ITR) (such as LEXAN® SLX Resin), N-phenylphenol phthaleinylbisphenol (PPP-BP) (such as LEXAN™ XHT Resin), or a combination comprising at least one of the foregoing.

The polymeric material can comprise a polyester. Polyesters include those derived from an aliphatic, cycloaliphatic, or aromatic diol, or mixtures thereof, containing from 2 to about 10 carbon atoms and an aliphatic, cycloaliphatic, or aromatic dicarboxylic acid, and have repeating units of the following general formula:

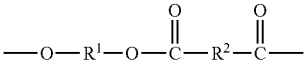

wherein $R^1$ and $R^2$ are each independently a divalent $C_1$-$C_{20}$ aliphatic radical, a $C_2$-$C_{12}$ cycloaliphatic alkyl radical, or a $C_6$-$C_{24}$ aromatic radical. The polyesters can be formed from terephthalic acid and a combination of ethylene glycol and cyclohexadimethanol, for example, formed from terephthalic acid and a combination of ethylene glycol, diethylene glycol and cyclohexadimethanol. Examples of polyesters include at least one of poly(ethylene terephthalate), spiroglycol modified polyethylene terephthalate, poly-cyclohexylenedimethylene terephthalate glycol, poly(1,4-cyclohexylenedimethylene 1,4-cyclohexanedicarboxylate), and polyethyelene naphthalate, poly-cyclohexylenedimethylene-terephthalate-glycol, polycyclohexylenedimethylene terephthalate, or polyethylene terephthalate with diethylene glycol. The polyester can comprise poly(ethylene terephthalate) ("PET"), e.g., unmodified PET. The polyester can comprise spiroglycol modified amorphous PET.

The polymeric material can comprise a polyolefin. The polyolefin comprises at least one of a homopolymer or a copolymer. The polyolefin can be of the general structure: $C_nH_{2n}$, where n can be 2 to 20. The polyolefin can include at least one of a polyethylene, a polypropylene, a polyisobutylene, or a polynorbornene. Examples of polyethylene include linear low density polyethylene (LLDPE), high density polyethylene (HDPE), and medium density polyethylene (MDPE). The polyolefin can include a polyolefin copolymer, for example, copolymers of ethylene and at least one of propene, 1-butene, 1-octene, 1-decene, 4-methylpentene-1,2-butene, 1-pentene, 2-pentene, 1-hexene, 2-hexene, 3-hexene, norbornene, or a diene (for example, 1,4 hexadiene, monocylic or polycyclic dienes). The polyolefin copolymer can include a heterophasic polyolefin. The polymeric material can include a polypropylene.

The polymeric material can include an additive. The additive can include at least one of a foaming agent, a flame retardant, an impact modifier, flow modifier, filler (e.g., a particulate polytetrafluoroethylene (PTFE), glass, carbon, mineral, or metal), reinforcing agent (e.g., glass fibers), antioxidant, heat stabilizer, light stabilizer, ultraviolet (UV) light stabilizer, UV absorbing additive, plasticizer, lubricant, release agent (such as a mold release agent), antistatic agent, anti-fog agent, antimicrobial agent, colorant (e.g., a dye or pigment), surface effect additive, radiation stabilizer, anti-drip agent (e.g., a PTFE-encapsulated styrene-acrylonitrile copolymer (TSAN)), or a combination thereof. For example, a combination of a heat stabilizer, mold release agent, and ultraviolet light stabilizer can be used. In general, the additives are used in the amounts generally known to be effective. When used as a support system for a water tank, the polymeric material can include a polyolefin (such as a polypropylene) and a glass fiber filler. An example of such a material is STAMAX® that is commercially available from SABIC's Innovative Plastics Business.

The system disclosed herein includes at least one of the following aspects:

Aspect 1: A transport system 100, including: a pallet 110, formed from plastic, wherein the pallet 110 extends heightwise 120 from a pallet top deck 130 to a pallet bottom deck 140 to define a pallet height, lengthwise 150 from a pallet forward end 160 to a pallet aft end 170 to define a pallet length, and widthwise 180 from a pallet first side 190 to a pallet second side 200 to define a pallet width, wherein, the pallet bottom deck 140 defines a pocket 210, the pocket 210 defines a pocket sidewall 220 that extends heightwise 120 into the pallet 110, from the pallet bottom deck 140 to a pocket base 230 to define a pocket height; and a pad 240, formed of an elastomer, having complementary shape to the pocket 210 and configured to be removably secured within the pocket 210, to define a pallet foot.

Aspect 2: The system of any of the preceding Aspects, wherein: pocket ribs 320 extend heightwise 120 from the pocket base 230 toward the pallet bottom deck 140; and the pocket ribs 320 form a grid that divides the pocket base 230 into pocket grid sections 230*a*, 230*b*, wherein the pocket ribs 320 are configured to engage pad grooves 330 formed in a pad top surface 250 of the pad 240 when the pad 240 is removably secured within the pocket 210.

Aspect 3: The system of any of the preceding Aspects, wherein: the pocket base 230 defines: a pocket base bottom 340 that faces heightwise 120 toward the pallet bottom deck 140; and a pocket base body 350 that extends heightwise 120 by a pocket base thickness from the pocket base bottom 340 to a pocket base top 360, wherein the pocket base top 360 is orientated to face heightwise 120 toward the pallet top deck 130; and wherein the pocket base bottom 340 is configured to engage the pad top surface 250 when the pad 240 is removably secured within the pocket 210.

Aspect 4: The system of any preceding Aspect, wherein: the pocket base 230 defines a fastener channel 370, wherein the fastener channel is defined by a fastener channel sidewall 380 that extends heightwise 120 from the pocket base bottom 340 to the pocket base top 360; the fastener channel 370 is cylindrical and defines a faster channel diameter, and wherein the fastener channel 370 is configured to be resiliently engaged by a fastener boss 390 that extends heightwise 120 from the pad top surface 250, wherein the fastener boss 390 is conformingly shaped to fit within the fastener channel 370.

Aspect 5: The system of any of the preceding Aspects, wherein: a plurality of the fastener channels 370*a*, 370*b* are respectively formed in ones of the pocket grid sections 230*a*, 230*b*; wherein: the fastener channels 370*a*, 370*b* are the same size as each other; or ones of the fastener channels 370*a*, 370*b* that are adjacent to either of the pallet first side 190 or pallet second side 200 have lager fastener channel diameters than others of the fastener channels 370*a*, 370*b*; and the fastener channels 370*a*, 370*b* are respectively configured to be resiliently engaged by a plurality of the fastener bosses 390*a*, 390*b* that extend upwardly, heightwise 120, from the pad top surface 250, wherein the fastener bosses 390*a*, 390*b* are conformingly shaped to fit within respective ones of the fastener channel 370*a*, 370*b*.

Aspect 6: The system of any of the preceding Aspects, wherein: the pallet 110 defines a fork entryway grid 460 between the pallet top and bottom decks 130, 140, wherein the fork entryway grid 460 defines: a first set of fork entryways 460*a* that extend lengthwise 150 from the pallet forward end 160 to the pallet aft end 170; and a second set of fork entryways 460*b* extending widthwise 180 from the pallet first side 190 to the pallet second side 200, wherein: along the pallet first side 190 and the pallet second side 200, first and second sets of the pockets 210*a*, 210*b* are respectively distributed lengthwise 150 so as to be located forward, between and aft of the second set of fork entryways 460*b* and offset widthwise 180 from the first set of fork entryways 460*a*; and the first and second sets of the pockets 210*a*, 210*b* are respectively configured to receive first and second sets of the pads 240*a*, 240*b*, and wherein the first and second sets of the pads 240*a*, 240*b* are respectively shaped to conform with the first and second sets of the pockets 210*a*, 210*b* to fit therebetween.

Aspect 7: The system of any of the preceding Aspects, wherein: along a center portion 470 of the pallet 110, a third set of the pockets 210*c* is distributed lengthwise 150 so as to be located forward, between and aft of the first set of fork entryways 460*b* and widthwise offset from the first set of fork entryways 460*a*; and the third set of the pockets 210*c* is configured to receive a third set of the pads 240*c*, wherein the third set of the pads 240*c* is shaped to conform with the third set of the pockets 210*c* to fit therebetween.

Aspect 8: The system of any of the preceding Aspects, wherein: the first and second sets of the pockets 210*a*-210*b* are wider than the third set of the pockets 210*c*, and the first and second sets of the pads 240*a*-240*b* are wider than the third set of the pads 240*c*, whereby the pallet 110 is configured for placement over different chain conveyers respectively configured with chains at differing widthwise locations.

Aspect 9: A pad 240 for placement in a pocket 210 of a pallet 110, the pad including: a pad top surface 250, wherein: the pad 240 extends heightwise 120 from the pad top surface 250 that to a pad bottom surface 260 to define a pad height, the pad 240 extends lengthwise 150 from a pad forward end 262 to a pad aft end 264 to define a pad length, and the pad 240 extends widthwise 180 from a pad first side 266 to a pad second side 268 to define a pad width; pad ribs 280 extend heightwise 120 from the pad bottom surface 260, the pad ribs 280 extend lengthwise 150 from the pad forward end 262 to the pad aft end 264, and the pad ribs 280 are spaced widthwise 180 from each other so that adjacent pairs of the pad ribs 280*a*, 280*b* respectively define a chain receiving track 310; and the pad is formed of an elastomer.

Aspect 10: The pad of Aspect 9, wherein: the pad 110 defines three chain receiving tracks 310*a*-310*c* that are adjacent, widthwise 180, to each other; and intermediate ones of pad ribs 280*b*1, 280*b*2 are the same thickness or thinner than outer ones of the pad ribs 280*a*1, 280*a*2 and/or are stiffer than the outer ones of the pad ribs 280*a*1, 280*a*2.

Aspect 11: The pad of any of Aspects 9-10, wherein: the pad top surface 250 defines pad grooves 330 that extend heightwise into the pad 110; and the pad grooves 330 divide the pad top surface 250 into pad grid sections 250*a*, 250*b*, respectively configured to engage pocket ribs 320 that extend heightwise 120 from the pocket 210 of the pallet 110.

Aspect 12: The pad of any of Aspects 9-11, wherein: a fastener boss 390 extends heightwise from the pad top surface 250; the fastener boss 390 defines a boss neck 400 having a cylindrical shape that defines a neck diameter, wherein the boss neck 400 extends heightwise 120 from the pad top surface 250 to a boss neck top end 410 by a neck height; an anchor head 420 that is formed at the boss neck top end 410; and the anchor head 420 defines an annulus having a diameter that is larger than the fastener channel diameter, wherein the anchor head 420 extends heightwise 120 from the boss neck top end 410 to an anchor head top end 425 by an anchor head height, wherein the anchor head 420 is configured to elastically deform and rebound, to thereby anchor the pad 240 to the pallet 110.

Aspect 13: The pad of any of Aspects 9-12, wherein: the fastener boss 390 defines a boss slot 430 that extends through the boss neck 400 and anchor head 420, whereby the anchor head 420 is configured to elastically compress.

Aspect 14: The pad of any of the preceding Aspects, wherein: a plurality of the fastener bosses 390*a*, 390*b* are respectively formed in the pad grid sections 250*a*, 250*b*; at least two of the fastener bosses 390*a*, 390*b* have neck diameters that differ from each other.

Aspect 15: A method including: positioning elastomer pads in pockets formed about a bottom deck of a plastic pallet that is configured to transport freight; and removing the pads from the pockets after transporting freight.

Aspect 16: A support system 700 including: a primary platform 705 defining a plastic pallet, the primary platform formed by primary platform segments 710*a*, 710*b*, that are interconnectable with each other, the primary platform segments 710*a*, 710*b* each include a first side 730 and a second side 740, the first and second sides 730, 740 each define one of notches 750 and tabs 760 to respectively mate with tabs and notches of other ones of the primary platform segments 710*a*, 710*b*, to thereby interconnect adjacent ones of the primary platform segments 710*a*, 710*b*, wherein the primary platform segments 710*a*, 710*b* each define primary legs 770*a*, 770*b* extending downwardly therefrom, wherein the primary legs 770*a*, 770*b* are sized to impart a primary slope 775 along the primary platform 705, wherein the primary slope can be 0.5 to 5 degrees, for example, 1 degree; and secondary platform segments 800*a*, 800*b* that are interconnectable with each other and with the primary platform segments 710*a*, 710*b* to form an extension 805 of the primary platform 705, wherein the secondary platform segments 800*a*, 800*b* each define secondary legs 820*a*, 820*b* extending downwardly therefrom, wherein the secondary legs 820*a*, 820*b* are sized so that the primary platform 705 and the extension 805 of the primary platform 705 are smoothly continuous and planar with each other, wherein the primary platform 705 has one of a circular and a rectangular shape; and wherein the primary platform 705 has one of a continuous and a discontinuous top surface 830.

In general, the embodiments can alternately comprise, consist of, or consist essentially of, any appropriate components herein disclosed. The embodiments can additionally, or alternatively, be formulated so as to be devoid, or substantially free, of any components, materials, ingredients, adjuvants or species used in the prior art compositions or that are otherwise not necessary to the achievement of the function and/or objectives of the present disclosure. The endpoints of all ranges directed to the same component or property are inclusive and independently combinable (e.g., ranges of "less than or equal to 25 wt %, or 5 wt % to 20 wt %," is inclusive of the endpoints and all intermediate values of the ranges of "5 wt % to 25 wt %," etc.). Disclosure of a narrower range or more specific group in addition to a broader range is not a disclaimer of the broader range or larger group. "Combination" is inclusive of blends, mixtures, alloys, reaction products, and the like. Furthermore, the terms "first," "second," and the like, herein do not denote any order, quantity, or importance, but rather are used to denote one element from another. The terms "a" and "an" and "the" herein do not denote a limitation of quantity, and are to be construed to cover both the singular and the plural, unless otherwise indicated herein or clearly contradicted by context. "Or" means "and/or." The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", "an aspect", and so forth, means that a particular element (e.g., feature, structure, and/or characteristic) described in connection with the embodiment is included in at least one embodiment described herein, and may or may not be present in other embodiments. In addition, it is to be understood that the described elements can be combined in any suitable manner in the various embodiments.

The terms "front", "back", "bottom", and/or "top" are used herein, unless otherwise noted, merely for convenience of description, and are not limited to any one position or spatial orientation. "Optional" or "optionally" means that the subsequently described event or circumstance may or may not occur, and that the description includes instances where the event occurs and instances where it does not. Unless defined otherwise, technical and scientific terms used herein have the same meaning as is commonly understood by one of skill in the art to which this disclosure belongs. A "combination" is inclusive of blends, mixtures, alloys, reaction products, and the like.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A transport system, comprising:

a pallet, formed from plastic, wherein the pallet extends heightwise from a pallet top deck to a pallet bottom deck to define a pallet height, lengthwise from a pallet forward end to a pallet aft end to define a pallet length, and widthwise from a pallet first side to a pallet second side to define a pallet width, wherein, the pallet bottom deck defines a pocket, the pocket defines a pocket sidewall that extends heightwise into the pallet, from the pallet bottom deck to a pocket base to define a pocket height;

wherein pocket ribs extend heightwise from the pocket base toward the pallet bottom deck, wherein the pocket ribs form a grid that divides the pocket base into pocket grid sections, wherein the pocket base defines: a pocket base bottom that faces heightwise toward the pallet bottom deck; and a pocket base body that extends heightwise by a pocket base thickness from the pocket base bottom to a pocket base top, wherein the pocket base top is orientated to face heightwise toward the pallet top deck, wherein the pocket base defines a fastener channel, wherein the fastener channel is defined by a fastener channel sidewall that extends heightwise from the pocket base bottom to the pocket base top, and wherein the fastener channel is cylindrical and defines a faster channel diameter; and a pad, formed of an elastomer, configured to be removable from the pocket, wherein the pad defines a pallet foot, wherein the pocket ribs are configured to engage pad grooves formed in a pad top surface of the pad when the pad is within the pocket, wherein the pocket base bottom is configured to engage the pad top surface when the pad is within the pocket, and wherein the fastener channel is configured to be resiliently engaged by a fastener boss that extends heightwise from the pad top surface, wherein the fastener boss is conformingly shaped to fit within the fastener channel.

2. The system of claim 1, wherein:

a plurality of the fastener channels are respectively formed in ones of the pocket grid sections;

wherein:

the fastener channels are the same size as each other; or ones of the fastener channels that are adjacent to either of the pallet first side or pallet second side have larger fastener channel diameters than others of the fastener channels; and the fastener channels are respectively configured to be resiliently engaged by a plurality of the fastener bosses that extend upwardly, heightwise, from the pad top surface, wherein the fastener bosses are conformingly shaped to fit within respective ones of the fastener channel.

3. The system of claim 1, wherein:

the pallet defines a fork entryway grid between the pallet top and bottom decks, wherein the fork entryway grid defines: a first set of fork entryways that extend lengthwise from the pallet forward end to the pallet aft end; and a second set of fork entryways extending widthwise from the pallet first side to the pallet second side, wherein:

along the pallet first side and the pallet second side, first and second sets of the pockets are respectively distributed lengthwise so as to be located forward, between and aft of the second set of fork entryways and offset widthwise from the first set of fork entryways; and the first and second sets of the pockets are respectively configured to receive first and second sets of the pads, and wherein the first and second sets of the pads are respectively shaped to conform with the first and second sets of the pockets to fit therebetween.

4. The system of claim 3, wherein:

along a center portion of the pallet, a third set of the pockets is distributed lengthwise so as to be located forward, between and aft of the first set of fork entryways and widthwise offset from the first set of fork entryways; and the third set of the pockets is configured to receive a third set of the pads, wherein the third set of the pads is shaped to conform with the third set of the pockets to fit therebetween.

5. The system of claim 4, wherein:

the first and second sets of the pockets are wider than the third set of the pockets, and the first and second sets of the pads are wider than the third set of the pads, whereby the pallet is configured for placement over different chain conveyers respectively configured with chains at differing widthwise locations.

6. The system of claim 2, wherein:

the fastener channels are the same size as each other.

7. The system of claim 2, wherein:

ones of the fastener channels that are adjacent to either of the pallet first side or pallet second side have larger fastener channel diameters than others of the fastener channels.

8. A pad for placement in a pocket of a pallet, the pad comprising:

a pad top surface, wherein:

the pad extends heightwise from the pad top surface to a pad bottom surface to define a pad height, the pad extends lengthwise from a pad forward end to a pad aft end to define a pad length, and the pad extends widthwise from a pad first side to a pad second side to define a pad width;

pad ribs extend heightwise from the pad bottom surface, the pad ribs extend lengthwise from the pad forward end to the pad aft end, and the pad ribs are spaced widthwise from each other so that adjacent pairs of the pad ribs respectively define a chain receiving track; and the pad is formed of an elastomer, wherein the pad defines three chain receiving tracks that are adjacent, widthwise, to each other; and wherein intermediate ones of pad ribs are the same thickness or thinner than outer ones of the pad ribs and/or are stiffer than the outer ones of the pad ribs, wherein a fastener boss extends heightwise from the pad top surface;

wherein the fastener boss defines a boss neck having a cylindrical shape that defines a neck diameter, wherein the boss neck extends heightwise from the pad top surface to a boss neck top end by a neck height;

wherein an anchor head that is formed at the boss neck top end; and wherein the anchor head defines an annulus having a diameter that is larger than a fastener channel diameter, wherein the anchor head extends heightwise from the boss neck top end to an anchor head top end by an anchor head height, wherein the anchor head is configured to elastically deform and rebound, to thereby anchor the pad to the pallet.

9. The pad of claim 8, wherein:

the pad top surface defines pad grooves that extend heightwise into the pad; and the pad grooves divide the pad top surface into pad grid sections, respectively configured to engage pocket ribs that extend heightwise from the pocket of the pallet.

10. The pad of any of claim 9, wherein:

the fastener boss defines a boss slot that extends through the boss neck and anchor head, whereby the anchor head is configured to elastically compress.

11. The pad of claim 9, wherein:

a plurality of the fastener bosses are respectively formed in the pad grid sections;

at least two of the fastener bosses have neck diameters that differ from each other.

12. A method of using the pad of claim 8, comprising:

positioning the pad in the pocket formed about a bottom deck of the pallet, wherein the pallet is configured to transport freight; and removing the pads from the pockets after transporting the freight.

13. A transport system, comprising:

a pallet, formed from plastic, wherein the pallet extends heightwise from a pallet top deck to a pallet bottom deck to define a pallet height, lengthwise from a pallet forward end to a pallet aft end to define a pallet length, and widthwise from a pallet first side to a pallet second side to define a pallet width, wherein, the pallet bottom deck defines a pocket, the pocket defines a pocket sidewall that extends heightwise into the pallet, from the pallet bottom deck to a pocket base to define a pocket height;

wherein pocket ribs extend heightwise from the pocket base toward the pallet bottom deck, wherein the pocket ribs form a grid that divides the pocket base into pocket grid sections, wherein the pocket base defines: a pocket base bottom that faces heightwise toward the pallet bottom deck; and a pocket base body that extends heightwise by a pocket base thickness from the pocket base bottom to a pocket base top, wherein the pocket base top is orientated to face heightwise toward the pallet top deck, wherein the pocket base defines a fastener channel, wherein the fastener channel is defined by a fastener channel sidewall that extends heightwise from the pocket base bottom to the pocket base top, and wherein the fastener channel is cylindrical and defines a faster channel diameter; and a pad, formed of an elastomer, having complementary shape to the pocket and configured to be removably secured within the pocket, to define a pallet foot, wherein the pocket ribs are configured to engage pad grooves formed in a pad top surface of the pad when the pad is removably secured within the pocket, wherein the pocket base bottom is configured to engage the pad top surface when the pad is removably secured within the pocket, and wherein the fastener channel is configured to be resiliently engaged by a fastener boss that extends heightwise from the pad top surface, wherein the fastener boss is conformingly shaped to fit within the fastener channel, wherein:

a plurality of the fastener channels are respectively formed in ones of the pocket grid sections;

wherein:

the fastener channels are the same size as each other; or ones of the fastener channels that are adjacent to either of the pallet first side or pallet second side have larger fastener channel diameters than others of the fastener channels; and the fastener channels are respectively configured to be resiliently engaged by a plurality of the fastener bosses that extend upwardly, heightwise, from the pad top surface, wherein the fastener bosses are conformingly shaped to fit within respective ones of the fastener channel, and wherein:

the pallet defines a fork entryway grid between the pallet top and bottom decks, wherein the fork entryway grid defines: a first set of fork entryways that extend lengthwise from the pallet forward end to the pallet aft end; and a second set of fork entryways extending widthwise from the pallet first side to the pallet second side, wherein:

along the pallet first side and the pallet second side, first and second sets of the pockets are respectively distributed lengthwise so as to be located forward, between and aft of the second set of fork entryways and offset widthwise from the first set of fork entryways; and the first and second sets of the pockets are respectively configured to receive first and second sets of the pads, and wherein the first and second sets of the pads are respectively shaped to conform with the first and second sets of the pockets to fit therebetween.

14. The system of claim 13, wherein:

along a center portion of the pallet, a third set of the pockets is distributed lengthwise so as to be located forward, between and aft of the first set of fork entryways and widthwise offset from the first set of fork entryways.

15. The system of claim 14, wherein:

the third set of the pockets is configured to receive a third set of the pads, wherein the third set of the pads is shaped to conform with the third set of the pockets to fit therebetween.

16. The system of claim 15, wherein:

the first and second sets of the pockets are wider than the third set of the pockets, and the first and second sets of the pads are wider than the third set of the pads, whereby the pallet is configured for placement over different chain conveyers respectively configured with chains at differing widthwise locations.

17. The system of claim 13, wherein:

the fastener channels are the same size as each other.

18. The system of claim 13, wherein:

ones of the fastener channels that are adjacent to either of the pallet first side or pallet second side have larger fastener channel diameters than others of the fastener channels.

19. A pad for placement in a pocket of a pallet, the pad comprising:

a pad top surface, wherein:

the pad extends heightwise from the pad top surface to a pad bottom surface to define a pad height, the pad extends lengthwise from a pad forward end to a pad aft end to define a pad length, and the pad extends widthwise from a pad first side to a pad second side to define a pad width;

pad ribs extend heightwise from the pad bottom surface, the pad ribs extend lengthwise from the pad forward end to the pad aft end, and the pad ribs are spaced widthwise from each other so that adjacent pairs of the pad ribs respectively define a chain receiving track; and the pad is formed of an elastomer, wherein the pad defines three chain receiving tracks that are adjacent, widthwise, to each other; and wherein intermediate ones of pad ribs are the same thickness or thinner than outer ones of the pad ribs and/or are stiffer than the outer ones of the pad ribs, wherein a fastener boss extends heightwise from the pad top surface;

wherein the fastener boss defines a boss neck having a cylindrical shape that defines a neck diameter, wherein the boss neck extends heightwise from the pad top surface to a boss neck top end by a neck height;

wherein an anchor head that is formed at the boss neck top end; and wherein the anchor head defines an annulus having a diameter that is larger than the fastener channel diameter, wherein the anchor head extends heightwise from the boss neck top end to an anchor head top end by an anchor head height, wherein the anchor head is configured to elastically deform and rebound, to thereby anchor the pad to the pallet, wherein:

the pad top surface defines pad grooves that extend heightwise into the pad; and the pad grooves divide the pad top surface into pad grid sections, respectively configured to engage pocket ribs that extend heightwise from the pocket of the pallet, wherein:

the fastener boss defines a boss slot that extends through the boss neck and anchor head, whereby the anchor head is configured to elastically compress, and wherein:

a plurality of the fastener bosses are respectively formed in the pad grid sections;

at least two of the fastener bosses have neck diameters that differ from each other.

20. A method of using the pad of claim 19, comprising:

positioning the pad in the pocket formed about a bottom deck of the pallet, wherein the pallet is configured to transport freight; and removing the pads from the pockets after transporting the freight.

* * * * *